US007905476B2

(12) United States Patent
Haramiishi

(10) Patent No.: US 7,905,476 B2
(45) Date of Patent: Mar. 15, 2011

(54) PAPER-SHEET HANDLING DEVICE

(75) Inventor: Kiichi Haramiishi, Gunma (JP)

(73) Assignee: Max Co., Ltd., Tokyo (JP)

( * ) Notice: Subject to any disclaimer, the term of this patent is extended or adjusted under 35 U.S.C. 154(b) by 369 days.

(21) Appl. No.: 12/066,805

(22) PCT Filed: Sep. 5, 2006

(86) PCT No.: PCT/JP2006/317580

§ 371 (c)(1),
(2), (4) Date: Mar. 13, 2008

(87) PCT Pub. No.: WO2007/032231

PCT Pub. Date: Mar. 22, 2007

(65) Prior Publication Data

US 2009/0288779 A1 Nov. 26, 2009

(30) Foreign Application Priority Data

Sep. 14, 2005 (JP) ..... 2005-267549

(51) Int. Cl.
*B65H 37/04* (2006.01)

(52) U.S. Cl. ..... 270/58.07; 270/58.12; 270/58.17; 270/58.27; 270/58.08

(58) Field of Classification Search ..... 270/58.07, 270/58.08, 58.12; 412/6, 7, 33, 38, 39, 40
See application file for complete search history.

(56) References Cited

U.S. PATENT DOCUMENTS

| | | | | |
|---|---|---|---|---|
| 4,155,134 | A * | 5/1979 | Pfaffle | 412/7 |
| 4,161,196 | A * | 7/1979 | Fabrig | 140/92.4 |
| 4,537,545 | A * | 8/1985 | Kunzmann | 412/7 |
| 2003/0031532 | A1 * | 2/2003 | Nolte et al. | 412/33 |

FOREIGN PATENT DOCUMENTS

| | | |
|---|---|---|
| JP | 11020362 | 1/1999 |
| JP | 200559396 | 3/2005 |

* cited by examiner

*Primary Examiner* — Leslie A Nicholson, III
(74) *Attorney, Agent, or Firm* — Chernoff, Vilhauer, McClung & Stenzel

(57) ABSTRACT

A paper-sheet handling device comprises a clamp movement mechanism for sandwiching a bundle of paper-sheets by attaching component guide members to a position covering a portion of punch holes from the front and rear surfaces of the bundle of paper-sheets. A binding component is bound to the bundle of paper-sheets while contacting both tip portions of the binding component to the binding component guide members and sandwiching the bundle of paper-sheets by the clamp movement mechanism. Such a configuration enables both tip portions of the binding component to insert into each perforated hole while keeping a distance between both tip portions of the binding component and each of the perforated holes substantially constant and at the same time, even in the case of binding components of different diameters, the distance between the binding component and an internal circumference of each of the holes perforated in the bundle of paper-sheets is kept substantially constant.

5 Claims, 34 Drawing Sheets

PAPER-SHEET HANDLING DEVICE

This is a national stage application filed under 35 USC 371 based on International Application No. PCT/JP2006/317580 filed Sep. 5, 2006, and claims priority under 35 USC 119 of Japanese Patent Application No. 2005-267549 filed Sep. 14, 2005.

TECHNICAL FIELD

This invention relates to a paper-sheet handling device that is preferably applied to an apparatus for performing a punching processing, a binding process or the like on recording paper-sheets released from a copy machine, a print machine or the like for black-and-white use and for color use. Particularly, a plurality of paper-sheets is sandwiched by attaching guide members, from front and rear surfaces of the plurality of paper-sheets, to positions in which a portion of each hole perforated thereon is covered, and then, the binding component is bound to the plurality of paper-sheets while contacting both tip portions of the binding component to the guide members by which the plurality of paper-sheets is sandwiched. This enables the both tip portions of the binding component to be inserted into each of the perforated holes while keeping a distance between the both tip portions of the binding component and an internal circumference of each of the holes perforated in the bundle of paper-sheets substantially constant and at the same time, even in case of the binding components with different diameters, enables the distance between the binding component and the internal circumference of each of the holes perforated in the bundle of paper-sheets to be kept substantially constant.

BACKGROUND ART

In recent years, a case in which a copy machine, a print machine or the like for black-and-white use and for color use is used by combining a paper-sheet handling device that carries out the perforation and binding processing has been increased. According to this kind of paper-sheet handling device, recording paper-sheets after the picture formation are received and is perforated on the downstream side of the paper-sheets thereof by utilizing the punching function. A plurality of paper-sheets after the perforation is aligned once again. A binding component is inserted automatically into perforated holes of the plurality of paper-sheets after the alignment.

On the other hand, when the binding component is automatically inserted into the perforated holes of the plurality of paper-sheets, fixing member for holding and fixing the binding component and insertion member for inserting the held and fixed binding component are used. The fixing member receives the developed binding component of a predetermined size from a binding component storing unit and holds and fixes it in a state of development. Also, the insertion member inserts the binding component held and fixed in the developed state by the fixing member to the perforated holes of the plurality of paper-sheets.

For example, a binding device has been disclosed in Japanese unexamined patent publication No. 2003-320780 (second page, FIG. 4). According to this binding device, when loose-leaf paper-sheets are bound by using a plastic made binder in which partitioned ring portions are arranged in parallel in both sides of a backbone portion, an elevator type stopper portion is provided, and this elevator type stopper portion is located at a front of the backbone portion of the binder held by the binder holding portion and also a rear side of the loose-leaf paper-sheet on a paper-sheet table and carries out a positioning of the loose-leaf paper-sheets. Such a configuration of the device enables the binder to be inserted into the holes inside of the loose-leaf paper-sheets.

Also, a binding process device has been disclosed in Japanese unexamined patent publication No. 2005-59396 (second page, FIG. 3). According to this binding process device, when loose-leaf paper-sheets in each of which a plurality of punch holes are formed along one side of paper are automatically bound by a binder, one pair of up and down pushers, an elevator drive mechanism which moves the pair of up and down pushers up and down symmetrically, and a drive motor are provided, in which the pair of pushers are driven in the closing direction, thereby closing the partitioned ring portions of the binder to sandwich the backbone portion of the binder, so that the partitioned ring portions forming a pair are inserted into the punch holes of the loose-leaf paper-sheets. Such a configuration of the device enables the stability in the insertion operation of the partitioned ring portions to be improved, and the occurrence of the insertion defection to be reduced.

DISCLOSURE OF INVENTION

Problem to be Solved by the Invention

However, relative to the paper-sheet handling devices in the conventional system, for example, the binding device as seen in Japanese unexamined patent publication No. 2003-320780 (second page, FIG. 4) fixes the position of the binder at a set position by the elevator type stopper portion and inserts the both tip portions of the binder directly into the holes of the loose-leaf, so at the time of changing the size of the binder, the binder goes out from the holes of the loose-leaf paper-sheets, consequently, there is a fear that the binder contacts the loose-leaf paper-sheets.

Also, in the binding process device as seen in Japanese unexamined patent publication No. 2005-59396 (second page, FIG. 3), similarly, the position of the backbone portion of the binder is fixed uniformly, also both tips of the binder are directly inserted into the holes of the loose-leaf, so at the time of changing a size of the binder, the binder goes out from the holes of the loose-leaf paper-sheets, consequently, there is a fear that the binder contacts the loose-leaf paper-sheets.

Means for Solving the Problem

For solving the aforesaid problem, a paper-sheet handling device is a paper-sheet handling device that produces a booklet by binding a binding component into holes perforated at predetermined positions of a plurality of respective paper-sheets, the paper-sheet handling device containing pressing means for guiding the plurality of paper-sheets that are perforated to a predetermined position and pressing them with alignment, guide-and-sandwich means, having guide members each for being attached to a position where the guide members cover a portion of each hole in the plurality of paper-sheets from front and rear surfaces of the plurality of paper-sheets pressed by the pressing means, for sandwiching the plurality of paper-sheets, and binding means for binding the binding component to the plurality of paper-sheets while contacting the both tip portions of the binding component to the guide members of the guide-and-sandwich means that sandwiches the plurality of paper-sheets.

By the paper-sheet handling device according to the present invention, in a case where the booklet is produced by binding the binding component into the holes perforated at predetermined positions of the plurality of respective paper-sheets, the guide-and-sandwich means, having the guide members each for being attached to a position where the guide members cover a portion of each hole in the plurality of paper-sheets from front and rear surfaces of the plurality of paper-sheets pressed by the pressing means, sandwiches the plurality of paper-sheets. The binding means binds the binding component to the plurality of paper-sheets while contacting the both tip portions of the binding component to the guide members of the guide-and-sandwich means that sandwiches the plurality of paper-sheets. Such a configuration enables the both tip portions of the binding component to be inserted into the perforated holes while keeping a distance between the both tip portions of the binding component and the internal circumference of each of the holes perforated in the bundle of paper-sheets substantially constant. Therefore, even in case of the binding components with different diameters, it is possible to keep the distance between the binding component and the internal circumference of each of the holes perforated in the bundle of paper-sheets substantially constant. Thus, without being affected by accumulated tolerance by any manufacturing of the aforesaid device component and the combination thereof, the highly accurate binding process can be realized by the simple component configuration.

BEST MODE FOR CARRYING OUT THE INVENTION

The present invention has an object to provide a paper-sheet handling device in which the both tip portions of the binding component can be inserted into the perforated holes while keeping a distance between the both tip portions of the binding component and the internal circumference of each of the holes perforated in the bundle of paper-sheets substantially constant, and at the same time, in case of the binding components of different diameters, the distance between the binding component and each of the perforated holes can be kept substantially constant. The following describe embodiments of the paper-sheet handling device according to this invention with reference to the drawings.

Figure 1:
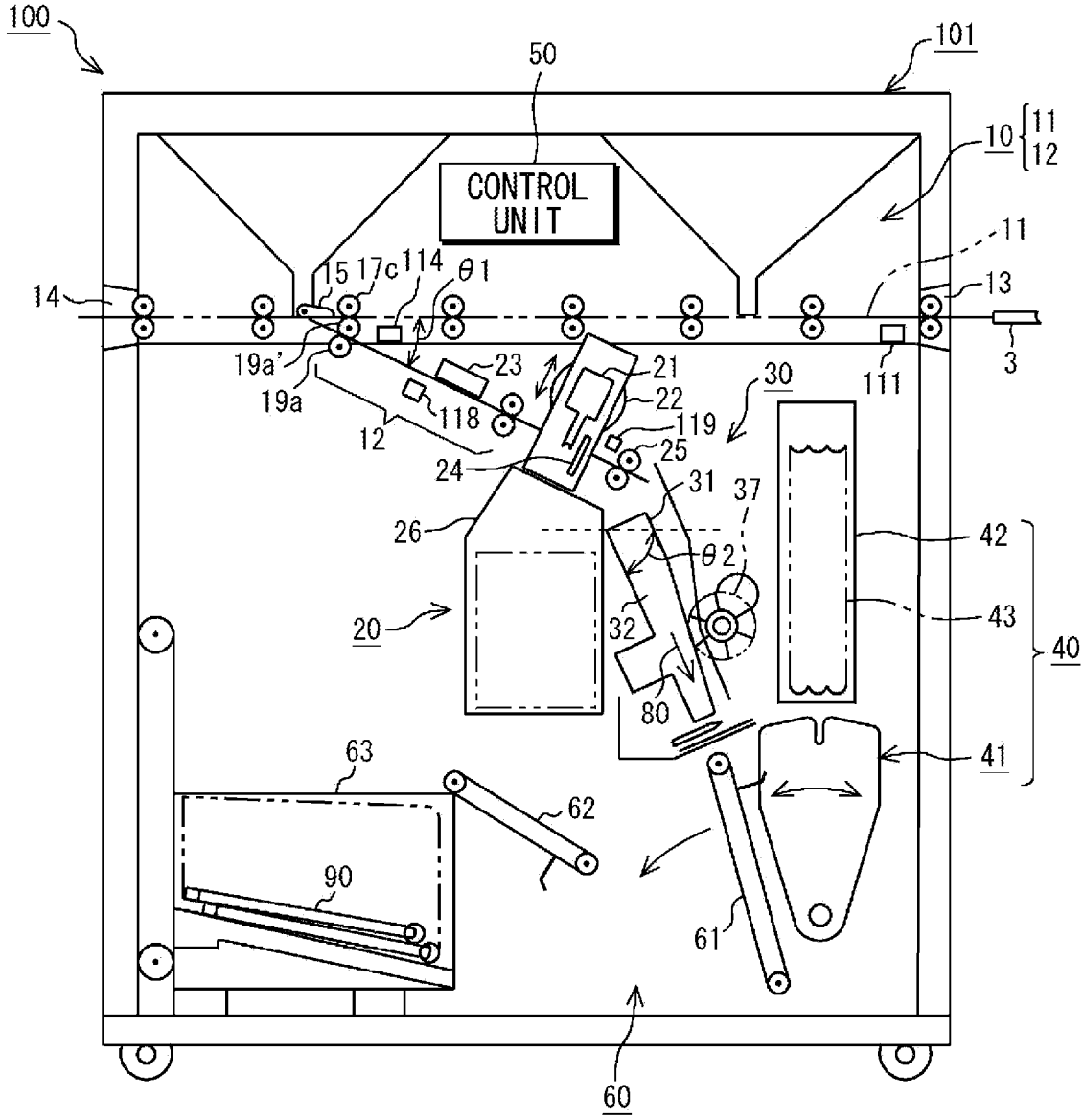
[FIG. 1] is a conceptual diagram showing a configuration example of a binding device 100 to which a paper-sheet handling device as an embodiment according to the present invention is applied.

The binding device 100 shown in FIG. 1 is a device which constitutes one example of the paper-sheet handling device producing a booklet by binding a binding component (consumables) 43 into holes perforated at predetermined positions of respective plural paper-sheets. For example, the binding device 100 performs a punching process on recording paper (hereinafter, merely referred to as paper-sheet 3) output from a copy machine or a print machine and thereafter, releases the papers after processing a binding process by a predetermined binding component 43. Of course, it may be applied to a device provided with a function of perforating holes on a predetermined paper-sheet 3 and outputting the paper directly without any change. The binding device 100 has a device body portion (housing) 101. It is preferable for the binding device 100 to be used in conjunction with a copy machine, a printing machine (picture forming device) or the like, and the device body portion 101 has a comparable height as that of a copy machine, a printing machine or the like.

A paper-sheet transport unit 10 is provided in the device body portion 101. The paper-sheet transport unit 10 has a first transport path 11 and a second transport path 12. The transport path 11 has a paper-feed inlet 13 and an outlet 14 and has a through-pass function for transporting the paper-sheet 3 drawn from the paper-feed inlet 13 toward the outlet 14 that becomes the predetermined position.

Here, the through-pass function means a function such that the transport path 11 positioned between a copy machine, a printing machine or the like on the upstream side and other paper-sheet handling device on the downstream side directly delivers the paper-sheet 3 from the copy machine, the printing machine or the like to the other paper-sheet handling device. In a case in which the through-pass function is selected, it is configured that the acceleration process of the transport rollers, the binding process or the like is omitted. The paper-sheet 3, usually, in case of one-side copy, is delivered in a state of the face down. It is configured that a paper feed sensor 111 is mounted on the paper-feed inlet 13 so as to output a paper feeding detection signal to a control unit 50 by detecting a front edge of the paper-sheet 3.

The transport path 12 has a switchback function by which the transport path is switchable from the aforesaid transport path 11. Here, the switchback function means a function that decelerates and stops the transport of the paper-sheet 3 at a predetermined position of the transport path 11, thereafter, switches the transport path of the paper-sheet 3 from the transport path 11 to the transport path 12, and also, delivers the aforesaid paper-sheet 3 in the reverse direction. It is configured that a flap 15 is provided in the transport path 11 to switch the transport path from the transport path 11 to the transport path 12.

Also, three cooperative transport rollers 17*c*, 19*aüf*, 19*a* are provided at a switch point between the transport path 11 and the transport path 12. The transport rollers 17*c* and 19*a* rotate clockwise and the transport roller 19*a*' rotates counter-clockwise. For example, it is constituted such that the transport roller 19*a*' is a drive roller and the transport rollers 17*c* and 19*a* are driven rollers. The paper-sheet 3 taken by the transport rollers 17*c* and 19*a*' decelerates and stops, but when it is restricted from the upper side to the lower side by the flap 15, it is transported to the transport path 12 by being fed by the transport rollers 19*a*' and 19*a*. It is configured that a paper-sheet detecting sensor 114 is disposed just before the three cooperative transport rollers 17*c*, 19*a*' and 19*a*, detects the front end and the rear end of the paper-sheet, and outputs a paper-sheet detection signal to the control unit 50.

A punching process unit 20 is arranged on the downstream side of the transport path 12. In this embodiment, it is designed so as to have a predetermined angle between the above-mentioned transport path 11 and transport path 12. For example, a first depression angle θ1 is set between a transport surface of the transport path 11 and a paper-sheet surface to be perforated of the punching process unit 20. Here, the paper-sheet surface to be perforated means a surface where holes are perforated in the paper-sheet 3. The punching process unit 20 is arranged so that the paper-sheet surface to be perforated can be set to a position having the depression angle θ1 on the basis of the transport surface of the transport path 11.

In the punching process unit 20, it is configured that two or more holes for the binding are perforated at the one end of the paper-sheet 3 which switchbacks from the transport path 11 and is transported by the transport path 12. The punching process unit 20 has, for example, a motor 22 that drives a shuttle operable punch blade 21. The paper-sheets 3 are perforated by the punch blade 21 driven by the motor 22 for every sheet.

An openable and closable fence 24 that becomes a reference of the perforation position is provided in the punching process unit 20 and is used so as to strike the paper-sheet 3 thereto. Further, it is configured that a side jogger 23 is provided in the punching process unit 20 so that the posture of the paper-sheet 3 is corrected. For example, a front edge of the paper-sheet 3 is made to be attached uniformly to the openable and closable fence 24. The fence 24 becomes a positional reference at the time of aligning the paper-sheet edge portion. A paper-sheet detecting sensor 118 is disposed just before the side jogger 23, detects the front end and the rear end of the paper-sheet, and outputs a paper-sheet detection signal to the control unit 50.

The punching process unit 20 stops the paper-sheet 3 by attaching it to the fence 24 and thereafter, perforates the front edge of the aforesaid paper-sheet 3. It should be noted that there is provided with a punch scrap storing unit 26 on the lower side of the punching processing main body and the punch scrap cut off by the punch blade 21 is made to be stored therein. It is configured that a paper output roller 25 is provided on the downstream side of the punching process unit 20 and transports the paper-sheet 3' after the paper-sheet perforation to the unit of the succeeding stage.

It is configured that a paper alignment unit 30 is arranged on the downstream side of the punching process unit 20 and holds (stores) temporarily a plurality of paper-sheets 3' (see FIG. 2) which are paper-outputted from the punching process unit 20 with the hole positions thereof being aligned. The paper alignment unit 30 is arranged so as to set the paper-sheet holding surface at the position having a second depression angle θ2 by making a transport surface of a transport path 11 to be a reference. Here, the paper-sheet holding surface means the surface that holds (stacks) paper-sheet 3' in each of which the holes are perforated. In this embodiment, a relation between the depression angle θ1 and the depression angle θ2 is set as $\theta 1<\theta 2$. This setting is for miniaturizing a width of the device body portion 101 and for transporting the paper-sheet 3 in a straight way under this condition. In this embodiment, with respect to the depression angle θ1, it is set as 0 degrees$<\theta 1<$45 degrees and with respect to the depression angle θ2, it is set as 0 degrees$<\theta 2<$90 degrees, respectively.

It is configured that the binder paper alignment unit 30 guides the paper-sheet 3' to a predetermined position when the paper proceeds and after the paper proceeding is completed, the rear end side of the paper-sheet 3' is immobilized. It is also configured that the binder paper alignment unit 30 guides the front end of the paper-sheet 3', at the time of the paper proceeding, to a proper position of a multiple paddles shaped rotating member (hereinafter, referred to as paddle roller) for aligning the front end and side end of the paper-sheet 3' to the reference position.

It is configured that in the downstream side of the binder paper alignment unit 30, a binding process unit 40 that produces a booklet 90 by binding the binding component 43 to plural paper-sheets 3' aligned by the aforesaid unit 30. The booklet 90 means the bundle of paper-sheets bound by inserting the binding component 43 thereinto.

In the embodiment, the binding process unit 40 has a movement mechanism 41 for inserting both tips of the binding component 43 into the perforated holes of the paper-sheet 3'. The movement mechanism 41 constitutes one example of binding means and binds the binding component 43 to plural paper-sheets. For example, it moves to shuttle between the transporting direction of the paper-sheet in the binder paper alignment unit 30 and a position perpendicular to the transporting direction in the aforementioned transport path 11 in a revolving way. The binding process unit 40 has the binder (binding component) cassette 42. The plurality of binding components 43 are set in the binder cassette 42. The binding component 43, for example, is made in the injection molding and a plurality of kinds thereof in response to the thickness of the bundle of paper-sheets is prepared.

The movement mechanism 41, for example, pulls out one piece of binding components 43 from the binder cassette 42 at the position perpendicular to the transporting direction of the transport path 11 and holds it and in this state, the movement mechanism 41 rotates to a position from which the paper-sheet transporting direction of the binder paper alignment unit 30 can be looked over. At this position, the binding process unit 40 receives the bundle of paper-sheets whose punch holes are position-determined from the binder paper alignment unit 30 and inserts the binding component 43 into the punch holes thereof to execute the binding process (automatic book-making function).

It is configured that in the downstream side of the binding process unit 40, a release unit 60 is arranged and the release processing for the booklet 90 produced by the binding process unit 40 is carried out. The release unit 60 is constituted so as to include, for example, a first belt unit 61, a second belt unit 62, and a stacker 63.

It is configured that the belt unit 61 receives the booklet 90 that is dropping from the binder paper alignment unit 30 and to switch the delivery direction thereof. For example, it is configured that the belt unit main body is turned around toward a predetermined release direction from the position from which the paper-sheet transporting direction of the binder paper alignment unit 30 can be looked over.

It is configured that the belt unit 62 receives the booklet 90 whose delivery direction is switched by the belt unit 61 and to transport it in the relay manner. It is configured that the stacker 63 accumulates the booklets 90 transported by the belt units 61 and 62.

Subsequently, a paper-sheet processing method in the binding device 100 according to the present invention will be explained with reference to FIG. 2.

Figure 2:
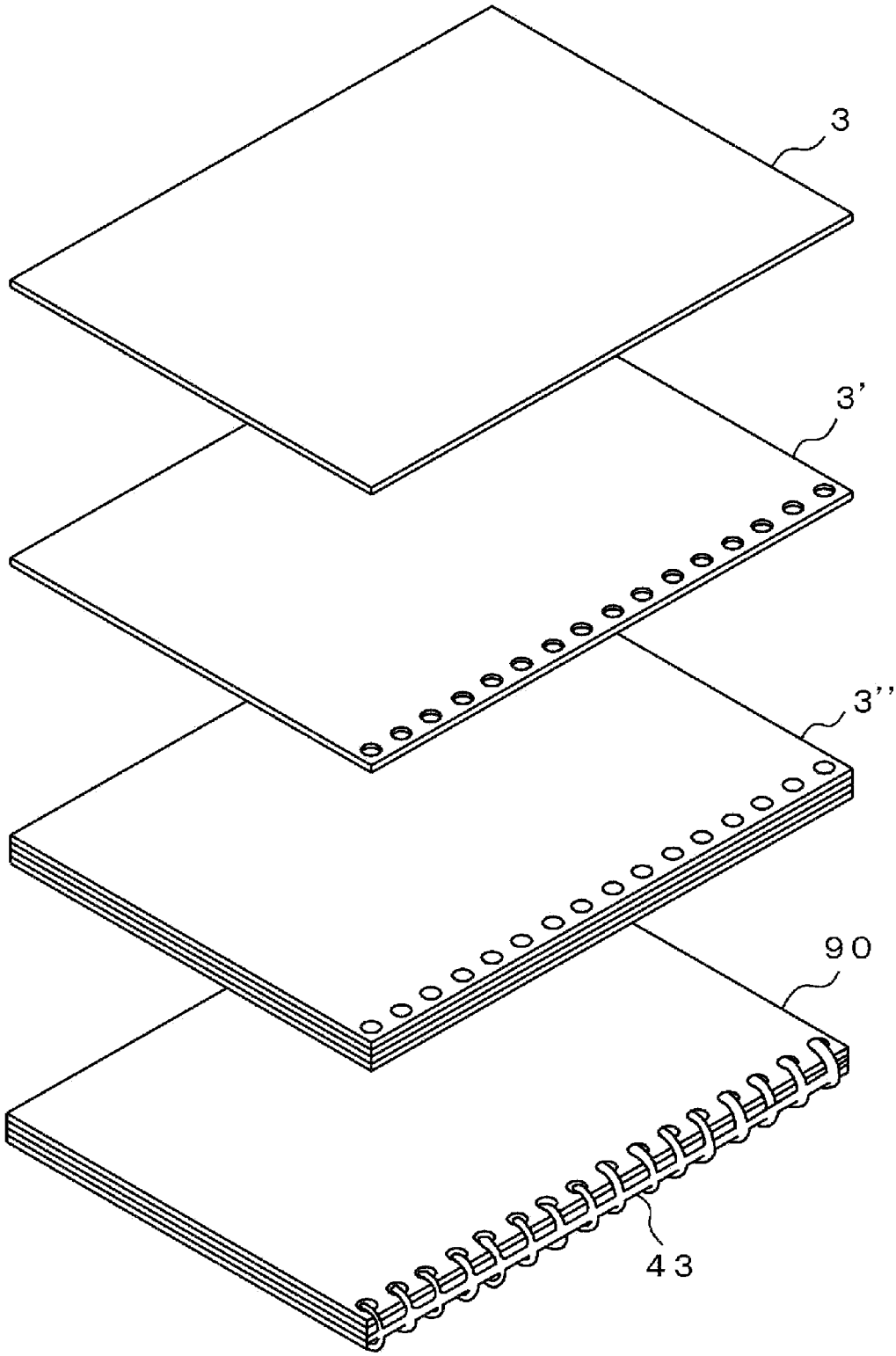
[FIG. 2] is a process diagram showing a function example of the binding device 100.

The paper-sheet 3 shown in FIG. 2 is one which is paper-fed from the upstream side of the aforesaid binding device 100. It is one in which punch holes are not perforated. The paper-sheet 3 is transported directed to a predetermined position of the transport path 11 shown in FIG. 1 and is decelerated and stopped at a predetermined position of the transport path 11. Thereafter, the transport path of the paper-sheet 3 is switched from the transport path 11 to the transport path 12 and also, the aforesaid paper-sheet 3 is delivered in the reverse direction and is transported to the punching process unit 20.

In the punching process unit 20, a predetermined number of holes for the binding is perforated at one edge of the paper-sheet 3. The paper-sheet 3' perforated with the holes for the binding is transported to the binder paper alignment unit 30. When reaching a preset quantity of the paper-sheets, it is configured that in the binder paper alignment unit 30, the positions of the holes for the binding thereof are aligned, for example, as the paper-sheets 3" shown in FIG. 2 and the binding component 43 is inserted into the holes thereof under the cooperation of the binding process unit 40. This enables the booklet 90, as shown in FIG. 2, inserted with the binding component 43 to be obtained.

Figure 3:
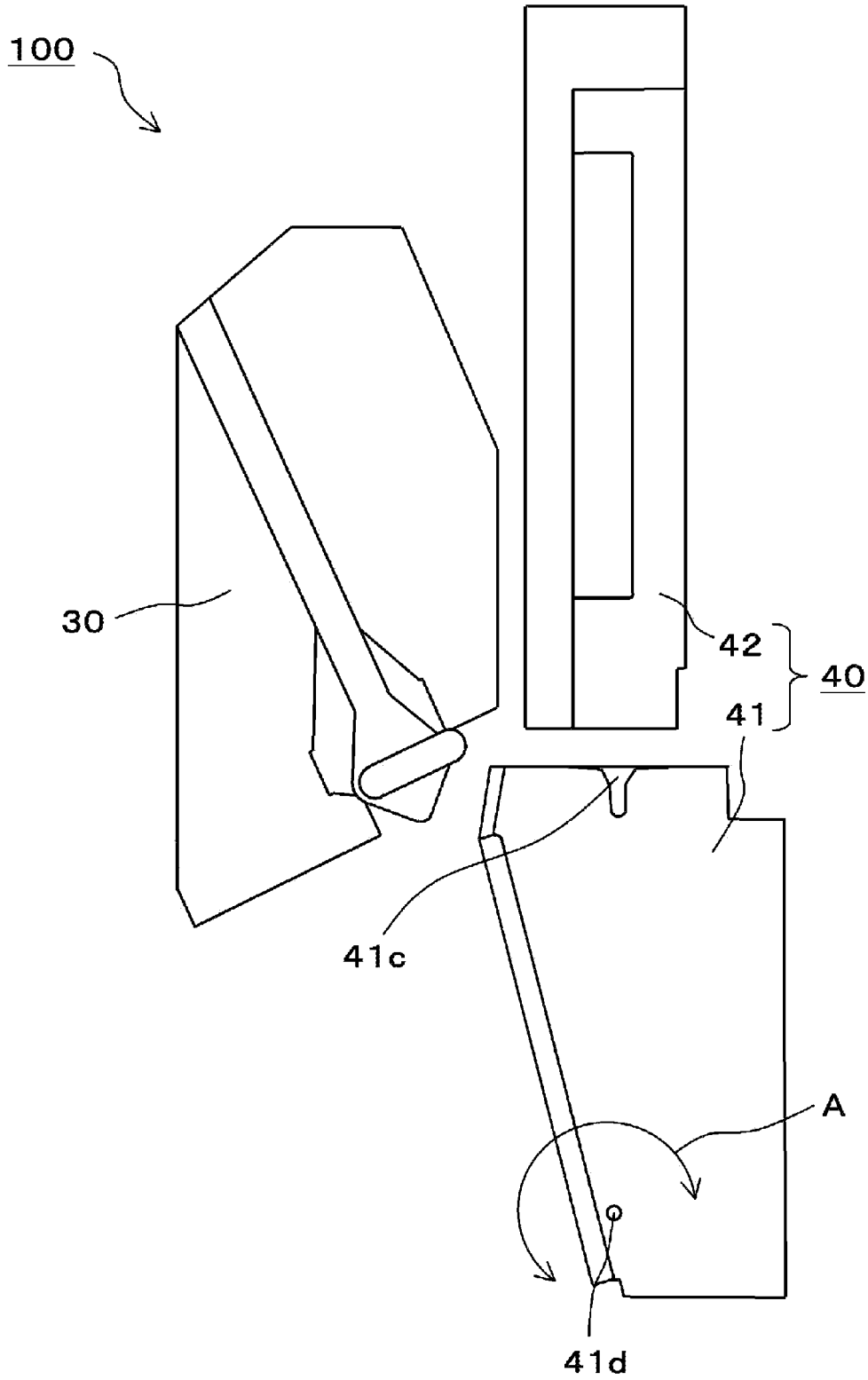
[FIG. 3] is a schematic diagram showing a configuration example of a binding process unit 40 and a paper alignment unit 30 when acquiring the binding component.
Figure 4:
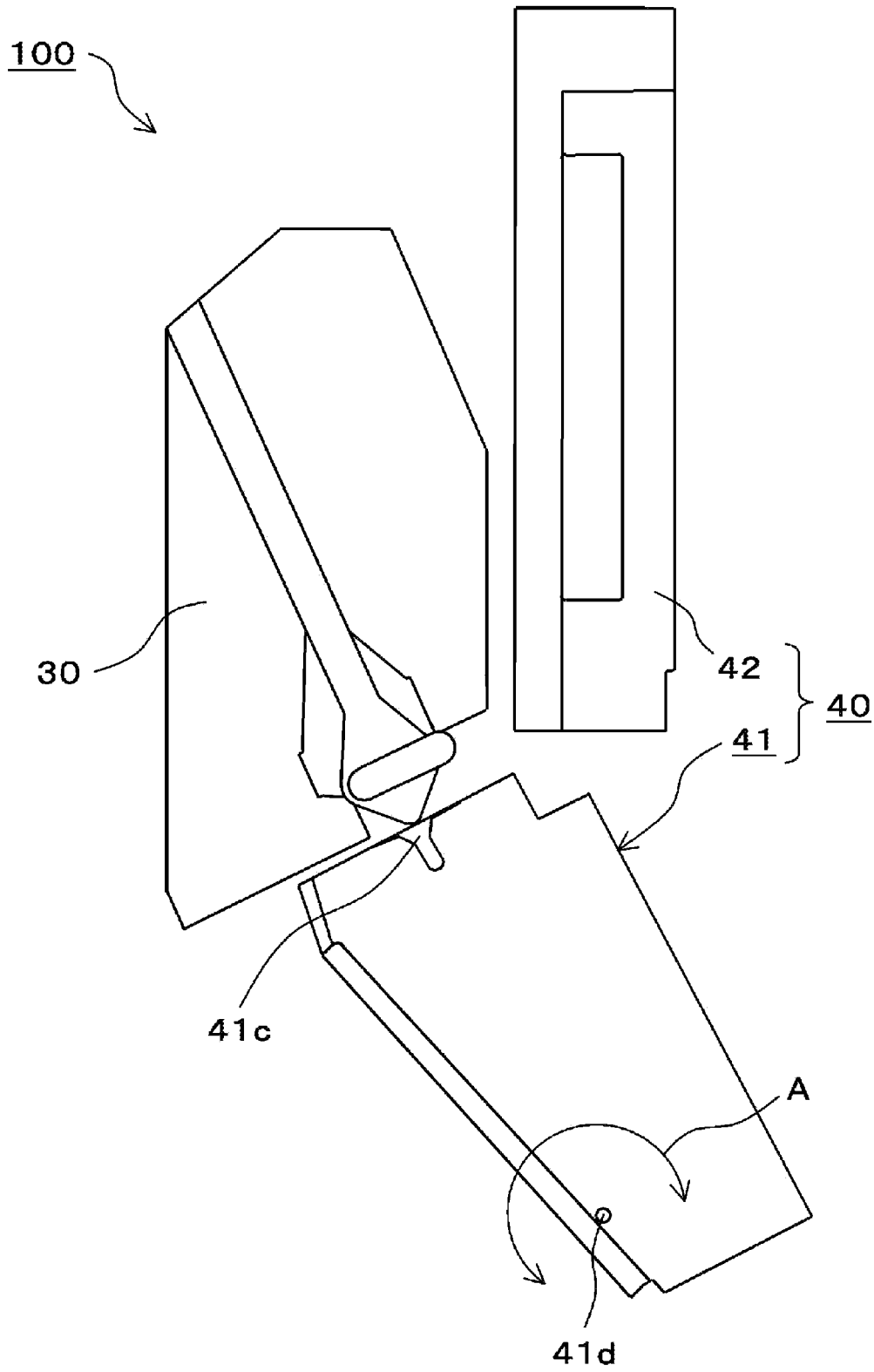
[FIG. 4] is a schematic diagram showing a configuration example of the binding process unit 40 and paper alignment unit 30 when performing binding process.

The following will describe a configuration example of the binding process unit 40 and the binder paper alignment unit 30 with reference to FIG. 3 at a binding component acquisition time. The binding process unit 40 shown in FIG. 3 is provided with the binder cassette 42 and the movement mechanism 41. The binding components 43 (which are not shown) are stacked and stored in the binder cassette 42. The movement mechanism 41 has an opening portion 41*c* and acquires the binding components 43 stacked in the binder cassette 42 by one piece by one round through the opening portion 41*c*. After the acquisition, as shown in FIG. 4, the movement mechanism 41 rotates in the counterclockwise direction on the axis of a movement mechanism rotating axis 41*d* and moves toward the paper alignment unit 30. In the paper alignment unit 30, the plural perforated paper-sheets are stored.

The following will describe a configuration example of the binding process unit 40 and the binder paper alignment unit 30 with reference to FIG. 4 at binding process time. The movement mechanism 41 shown in FIG. 4 has the opening portion 41*c*, is a rotated state in the counterclockwise direction on the axis of the movement mechanism rotating axis 41*d* from the state shown in FIG. 3, and inserts the binding component 43 (which is not shown) held by a binding component gripping portion 41*b* shown in FIGS. 18A and 18B into the bundle of the paper-sheets 3" shown in FIG. 2 provided from the paper alignment unit 30. After the insertion, the movement mechanism 41 releases the binding component 43, rotates in the clockwise direction on the axis of the movement mechanism rotating axis 41*d*, and moves to a position right under the binder cassette 42, which is the state shown in FIG. 3. The bundle of the paper-sheets 3" is bound with the binding component so that the booklet 90 can be formed, and thereafter, the process proceeds to a next paper-sheet processing step.

Figure 5:
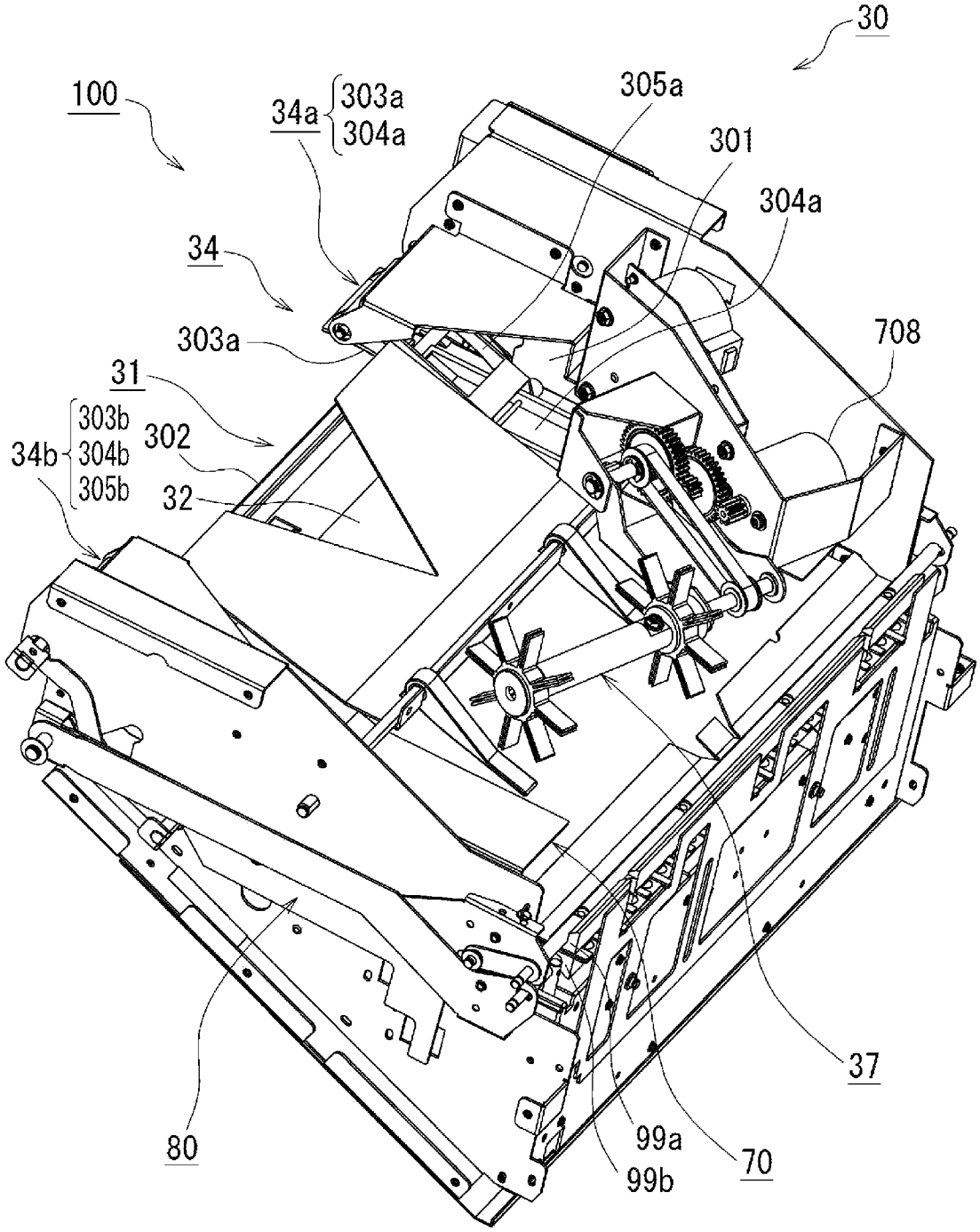
[FIG. 5] is a perspective view showing a configuration example of the binder paper alignment unit 30.

The following will describe a configuration example of the binder paper alignment unit 30 with reference to FIG. 5. The binder paper alignment unit 30 shown in FIG. 5 is a unit which aligns and temporarily reserves the paper-sheets 3' transported by the paper-sheet transport unit 10.

The binder paper alignment unit 30 constitutes one example of pressing means and has a paper-sheet guide pressing mechanism 31. The paper-sheet guide pressing mechanism 31 guides to a predetermined position and aligns and holds down a plurality of perforated paper-sheets 3'. For example, it is configured that the paper-sheet guide pressing mechanism 31 guides the paper-sheet 3' to a predetermined position when the paper proceeds, and after the paper proceeding is completed, for example, the rear end side of the paper-sheet 3' is immobilized at the time of the binding process.

The paper-sheet guide pressing mechanism 31 is constituted by including, for example, a paper-sheet reserving unit 32 and right/left rotatable guide portions 34*a* and 34*b*. The paper-sheet reserving unit 32 is a unit which stores and temporarily reserves the paper-sheet 3'.

The rotatable guide portion 34*a* operates such that one side thereof guides the paper-sheet 3' to the paper-sheet reserving unit 32 when the paper-sheet proceeds and the paper-sheet 3' is to be immobilized after the paper proceeding is completed. The rotatable guide portion 34*a* is constituted by including, for example, a solenoid 301, a connecting rod 302, a guide frame 303*a*, a pressing member 304*a*, and a link mechanism 305*a*.

The rotatable guide portion 34*b* operates such that the other side thereof guides the paper-sheet 3' to the paper-sheet reserving unit 32 when the paper-sheet proceeds and the paper-sheet 3' is to be immobilized after the paper proceeding is completed. The rotatable guide portion 34*b* is constituted by including, for example, a guide frame 303*b*, a pressing member 304*b* and a link mechanism 305*b*.

A pair of link mechanisms 305*a*, 305*b* is arranged on the right and left sides of the paper-sheet reserving unit 32. The link mechanisms 305*a*, 305*b* are engaged freely rotatably by the connecting rod 302. For example, the solenoid 301 is mounted on the one link mechanism 305*a*. The solenoid 301 is mounted on the paper-sheet reserving unit main body.

It is configured in this embodiment that the reciprocating movement of the solenoid 301 is transmitted to the right and left link mechanisms 305*a*, 305*b*. The guide frame 303*a* is attached to the link mechanism 305*a* and the guide frame 303*b* is attached to the link mechanism 305*b*. It is configured that the respective guide frames 303*a*, 303*b* have R-curve (R-shape) projecting toward the upper direction from the paper surface of the paper-sheet 3', which guides the paper-sheet 3' to the paper-sheet reserving unit 32. It is configured that the solenoid 301 mentioned above drives the guide frames 303*a*, 303*b* through the right and left link mechanism 305*a*, 305*b* to activate the pressing member 304*a*, 304*b*.

The pressing member 304*a* is rotatably attached to a front edge of the guide frame 303*a* and operates so as to immobilize the paper-sheet 3' after the paper proceeding is completed. The pressing member 304*a* is, for example, an injection molded component by resin and the bottom region thereof has a flat shape. The size thereof is 20 mm to 30 mm in width and around 60 mm to 80 mm in length. The thickness thereof is around 8 mm to 10 mm.

When, for example, the paper-sheet proceeds, the pressing member 304*a* is constituted so as to become an extended guide of a moving guide shape which has been formed by the rotatable guide portion 34*a* and the pressing member 304*a* is always biased by a biasing member in an open state of the immobilizing function by the aforesaid pressing member 304*a* so as to become a moving guide shape of a mode cooperating with the moving guide shape by the rotatable guide portion 34*a*. The pressing member 304*a* has such a structure that the pressing member 304*a* is touched to the paper-sheet 3' with tracing it after the paper proceeding is completed and holds down the aforesaid paper-sheet 3' by a flat surface thereof. The guide frame 303*b* and the pressing member 304*b* are constituted similarly. In the holding and fixing portion where the clamp movement mechanism 80 holds and fixes the bundle of paper-sheets 3" open-close freely rotatably, binding component guide members 99*a*, 99*b* are arranged.

Figure 6:
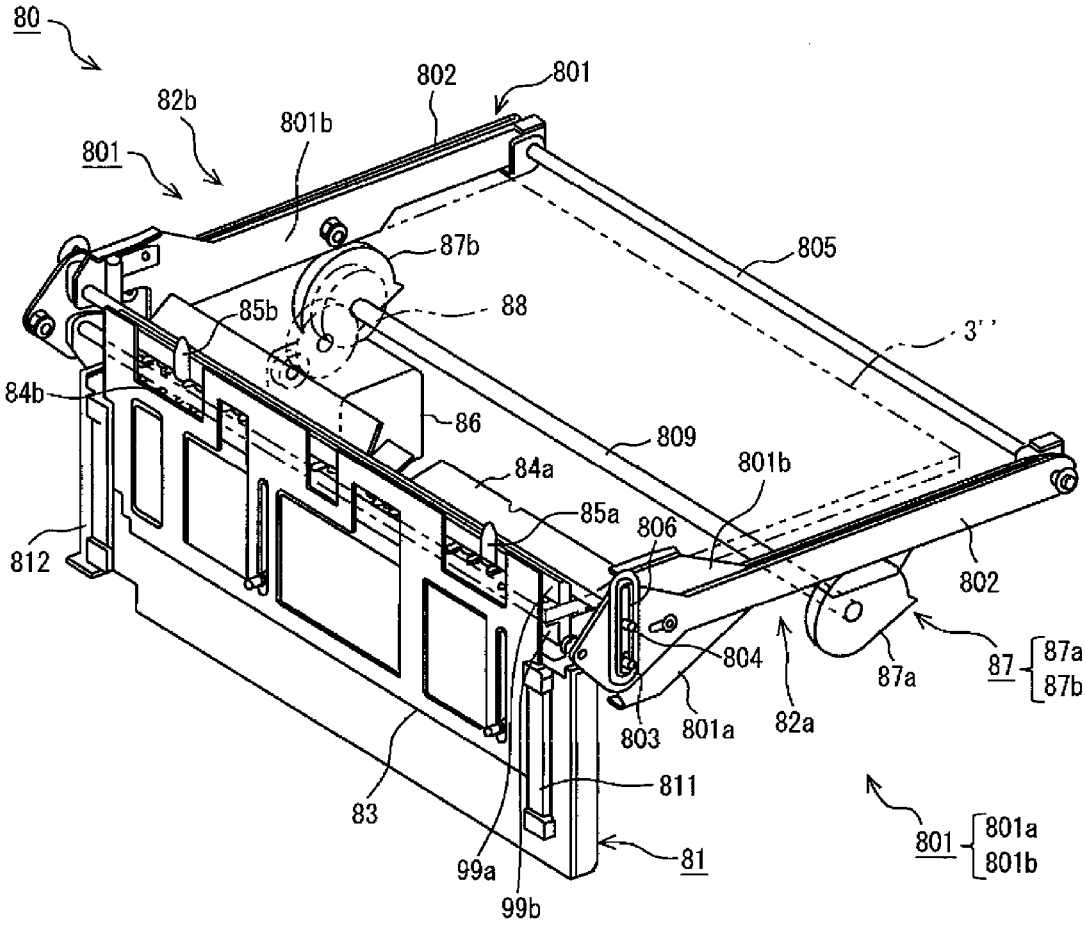
[FIG. 6] is a perspective view showing a configuration example of a clamp movement mechanism 80 in the binder paper alignment unit 30.
Figure 7A:
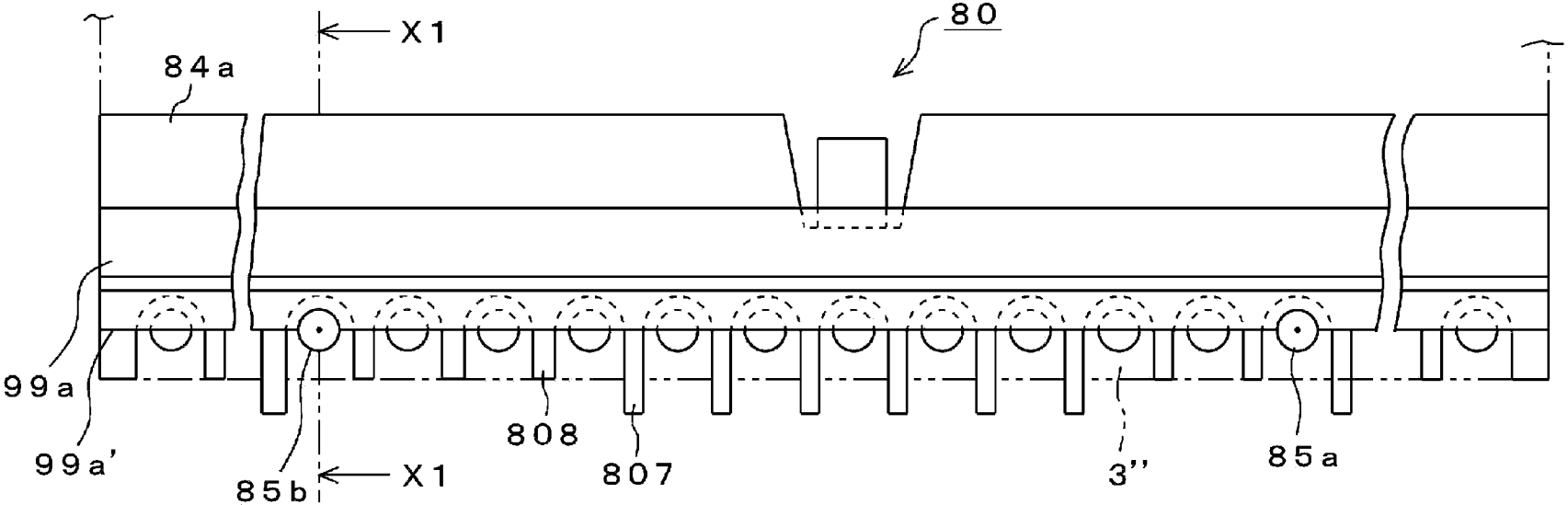
[FIG. 7A] is a partially fragmentized top view showing a configuration example of a comb shaped pressing member 84*a* and binding component guide members 99*a*, 99*b* of the clamp movement mechanism 80.
Figure 7B:
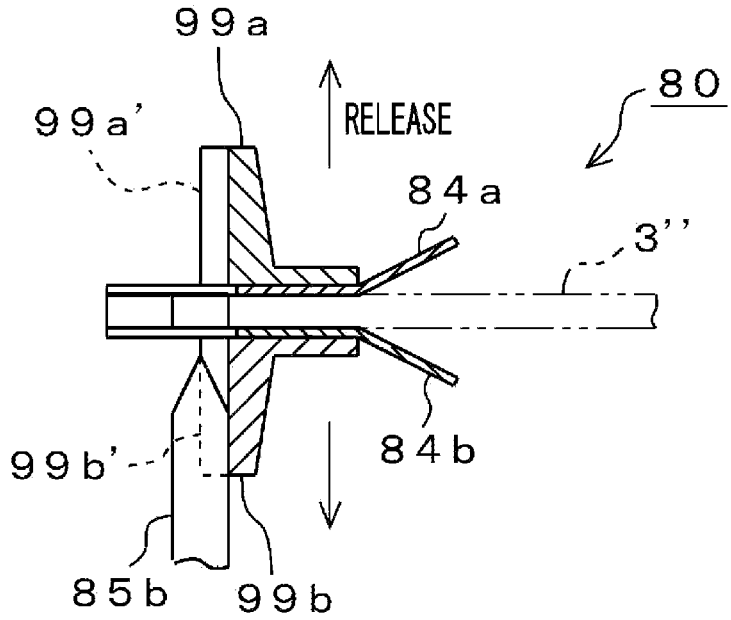
[FIG. 7B] is a cross-section diagram seen from X1-X1 arrows showing a configuration example before the insertion of an alignment pin 85*b* of the clamp movement mechanism 80 shown in FIG. 7A.
Figure 7C:
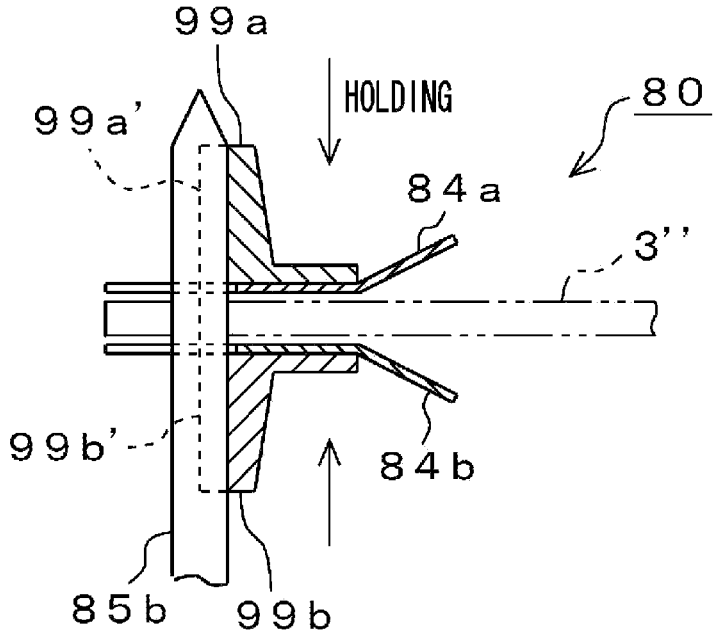
[FIG. 7C] is a cross-section diagram seen from X1-X1 arrows showing a configuration example after the insertion of the alignment pin 85*b* of the clamp movement mechanism 80 shown in FIG. 7A.

The following will describe a configuration example of the clamp movement mechanism 80 in the binder paper alignment unit 30 with reference to FIG. 6, a configuration examples of comb shaped pressing members 84*a*, 84*b* of the clamp movement mechanism 80 and the binding component guide members 99*a*, 99*b* with reference to FIG. 7A, an alignment pin 85*b* of the clamp movement mechanism 80 before the insertion with reference to FIG. 7B, and the alignment pin 85*b* of the clamp movement mechanism 80 after the insertion with reference to FIG. 7C.

The clamp movement mechanism 80 shown in FIG. 6 fixes an edge portion of the hole-side of the bundle of paper-sheets 3", and moves a little bit along the paper-sheet transporting direction from the paper-sheet guide pressing mechanism 31 to the downstream side for inserting the binding component 43 that a movement mechanism 41 shown in FIG. 4 holds.

The clamp movement mechanism 80 is constituted by including a main body substrate 81, clamp members 82*a*, 82*b*, a shutter 83, comb shaped pressing members 84*a*, 84*b*, alignment pins 85*a*, 85*b*, a motor 86, cams 87*a*, 87*b*, a gear unit 88 and binding component guide members 99*a*, 99*b*. The clamp movement mechanism 80 constitutes one example of guide-and-sandwich means and sandwiches the bundle of paper-sheets 3" by the binding component guide members 99*a*, 99*b* for being applied to a position covering a portion of each of the punch holes of the paper-sheets 3" from the front and rear surfaces of the bundle of paper-sheets 3' held down by the paper-sheet guide pressing mechanism 31. The movement mechanism 41 shown in FIG. 4 binds binding component 43 to the bundle of paper-sheets 3" while contacting both tip portions of the binding component 43 to the binding component guide members 99*a*, 99*b* of the clamp movement mechanism 80 sandwiching the bundle of paper-sheets 3".

The main body substrate 81 is constituted by including a front surface region and side surface regions. The main body substrate 81 is formed with a front surface region and right/left side surface regions by performing any bend-processing on an iron plate. The left side surface region occupies a larger region than that of the right side surface region. In this embodiment, a motor mounting region is provided inside the left side surface region, a mounting region of the clamp member 82*a* is provided on the upper side of the left side surface region, and a mounting region of the clamp member 82*b* is provided on the upper side of the right side surface region, respectively. The clamp members 82*a*, 82*b*, the shutter 83, the comb shaped pressing member 84*a*, 84*b*, the alignment pins 85*a*, 85*b*, the motor 86, the cams 87*a*, 87*b*, the gear unit 88, and binding component guide members 99*a*, 99*b* are respectively, arranged on the main body substrate 81.

The clamp members 82*a*, 82*b* are rotatably mounted at the upper portions on the both side edges of the main body substrate 81 and they operate so as to hold and fix the bundle of paper-sheets 3" or so as to release it in a free state. The clamp member 82*a* on the right edge side is constituted by including, for example, a clip-shaped member 801 and a member 802 having a sword-tip shape at the front edge thereof with a restriction hole.

The clip-shaped member 801 is constituted by including a pair of movable members 801*a*, 801*b*. A first connecting rod 803 is movably mounted on one terminal of the one movable member 801*a*. A second connecting rod 804 is movably mounted on one terminal of the other movable member 801*b*. The other edges of the (pair of) movable members 801*a*, 801*b* are engaged with a fulcrum axis member 805 rotatably together with the other edge of the member 802 with a restriction hole.

The member 802 with a restriction hole has an elongated opening portion 806 for clamp open-close restriction, which restricts the movement of the first connecting rod 803 and second connecting rod 804. They are assembled so that the edge portions of the connecting rods 803, 804 can be exposed from the opening portion 806.

As shown in FIG. 7A, the comb shaped upper portion pressing member 84*a* is mounted on the first connecting rod 803 by a screw with sandwiching the binding component guide member 99*a*, and the comb shaped lower portion pressing member 84*b* is mounted on the second connecting rod 804 with sandwiching the binding component guide member 99*b*. The binding component guide members 99*a*, 99*b* have binding component guide surfaces 99*a*', 99*b*' and are mounted on the connecting rods 803 and 804 so that the binding component guide surfaces 99*a*', 99*b*' face to the comb shaped direction of the comb shaped pressing members 84*a*, 84*b*.

The alignment pins 85*a*, 85*b* are movably mounted in the vertical direction with respect to the bundle of paper-sheets 3" aligned at a predetermined position of the paper-sheet guide pressing mechanism 31, and align the punch holes of the bundle of paper-sheets 3".

The binding component guide members 99*a*, 99*b* are the same plastic material as that of the binding component 43. This is for reducing the friction or the like that occurs between both tip portions of the binding component 43 and the binding component guide surface 99*a*', 99*b*' because binding component 43 is bound to the punch holes of the paper-sheet while contacting the both tip portions of binding component 43 to the binding component guide surfaces 99*a*', 99*b*'. The longest regions of the binding component guide members 99*a*, 99*b* are almost the same lengths as the longest regions of the comb shaped pressing members 84*a*, 84*b*. Thus, it is possible to guide the both tip portions of the binding component 43 to all punch holes excepting for the punch holes into which the alignment pins 85*a*, 85*b* are inserted.

Position in which the binding component guide members 99*a*, 99*b* cover a portion of each of the punch holes of the bundle of paper-sheets 3" from the front and rear surfaces of the bundle of paper-sheets 3" is set by attaching the alignment pins 85*a*, 85*b* to concave portions provided at predetermined positions of the binding component guide members 99*a*, 99*b*. The extent that the binding component guide members 99*a*, 99*b* whose position are fixed by the alignment pins 85*a*, 85*b* cover each of the punch holes is determined by a degree of depression (degree of cut-off) of the region where the binding component guide members 99*a*, 99*b* attach to the alignment pins 85*a*, 85*b*. For example, as shown in FIG. 7A, the concave portions are provided in the right and left of each of the binding component guide members 99*a*, 99*b*, and a position where the binding component guide members 99*a*, 99*b* cover a portion of each of the punch holes of the bundle of paper-sheets 3" from the front and rear surfaces of the bundle of paper-sheets 3" is set at a position in which a tip portion that links each two concave portions in the binding component guide members 99*a*, 99*b* covers about half of the punch holes of the bundle of paper-sheets 3". As shown in FIGS. 7B and 7C, if the concave portions of the binding component guide members 99*a*, 99*b* are formed so as to house a semicircle portion of arc of each of the alignment pins 85*a*, 85*b*, about half size of each of the punch holes is covered by the binding component guide members 99*a*, 99*b*. Thus, the both tip portions of the binding component 43 are inserted into the punch holes while contacting the binding component guide surfaces 99*a*', 99*b*'. A usage example of these binding component guide members 99*a*, 99*b* will be explained in detail with FIGS. 25 and 26.

Also, the extent that the binding component guide members 99*a*, 99*b* each having these two concave portions cover a portion of each of the punch holes is determined as a condition in which the binding component 43 of largest diameter is bound to the bundle of paper-sheets 3", the thickness of which becomes a maximum. If the binding component 43 is able to be bound to the punch holes while contacting it to the binding component guide members 99*a*, 99*b* in a condition in which the binding process is most difficult, it becomes possible to bind the binding component 43 to the punch holes without depending on the thickness of the bundle of paper-sheets 3" and the size of diameter of the binding component 43.

The comb shaped upper portion pressing member 84*a* has a comb-tooth region cut out in a U-shape. The arrangement pitch of this comb-tooth region is made to be equal to the arrangement pitch of the punch holes of the bundle of paper-sheets 3".

The comb-shaped portions are formed by intermingling a long-tooth region 807 with a short-tooth region 808. The long-tooth region 807 is arranged so as to protrude ahead compared with the paper edge portion of the bundle of paper-sheets 3" and the short-tooth region 808 is arranged so as to withhold on the near side compared with the paper edge portion of the bundle of paper-sheets 3". This is because by fitting the long-tooth region 807 with the region selectively opened at the shutter 83, the holding and fixing accuracy of the upper portion pressing member 84*a* and the lower portion pressing member 84*b* is improved and the closing function of the shutter is also improved.

The clamp member 82*b* on the left edge side is formed similarly as that on the right edge side, so that the explanation thereof will be omitted. The clamp member 82*b* on the left edge side and the clamp member 82*a* on the right edge side are rotatably engaged on the fulcrum axis member 805 at the rear end thereof and at the same time, at the front end, the connecting rods 803, 804 mounted on the clip-shaped members 801 are movably engaged with the member 802 with a restriction hole, so that a clamp mechanism to be constituted. Also, the clamp members 82*a*, 82*b* have such a structure that they move along the paper-sheet transporting direction in a state in which the bundle of paper-sheets 3" is held with respect to the main body substrate 81. This enables the clamp movement mechanism 80 to be constituted.

The motor 86 is mounted in a motor mounting region provided inside the left side surface region. It is configured that the motor 86 is engaged with the gear unit 88, the motor rotational frequency is converted by a predetermined gear ratio, and the motor rotational force is transmitted to the cams 87*a* and 87*b*. The gear unit 88 is mounted with the one cam 87*b*. The cam 87*b* is mounted on the other cam 87*a* through a cam cooperative member 809. The aforementioned movable member 801*a* or 801*b* includes a cam operative region. It is configured that in each of the clamp members 82*a* and 82*b*, the clip-shaped member 801 of each of the clamp members 82*a* and 82*b* opens and closes synchronously by depressing the cams 87*a*, 87*b* at the cam operative region of the movable member 801*a* or 801*b*.

It should be noted that the shutter 83 is movably mounted on the front face of the main body substrate 81 and operates so as to limit the release of the bundle of paper-sheets 3" stored in the paper-sheet reserving unit 32. It is configured that the shutter 83 is driven up and down in the direction perpendicular to the transporting direction of the bundle of paper-sheets 3". It is configured that sliding members 811, 812 are provided on both sides of the shutter 83 and the shutter 83 slides along the sliding members 811, 812. In this embodiment, when the clamp members 82*a*, 82*b* make the bundle of paper-sheets 3" to be in a freely open state, it is possible to stop the natural drop of the bundle of paper-sheets 3" by closing the shutter 83.

Also, the alignment pins 85*a*, 85*b* are movably mounted inside the front surface region of the main body substrate 81 and it is configured that by fitting the alignment pins 85*a*, 85*b* into the punch holes of the bundle of paper-sheets 3" before the binding process, the positions thereof are aligned. The front edges of respective alignment pins 85*a*, 85*b* have conical shapes. For example, the bundle of paper-sheets 3" is made to be sandwiched and held between the upper portion pressing member 84*a* and the lower portion pressing member 84*b* before inserting the alignment pins 85*a*, 85*b* as shown in FIG. 7B. Thereafter, in order to align the positions of the holes of the bundle of paper-sheets 3" by the alignment pins 85*a*, 85*b*, the clamp members 82*a*, 82*b* are opened in a state of binding the shutter 83. Thereafter, as shown in FIG. 7C, the alignment pin 85*b* is fitted to the holes of the bundle of paper-sheets 3". The main body substrate 81 on which these members are mounted is mounted on the binder paper alignment unit main body portion.

Figure 8:
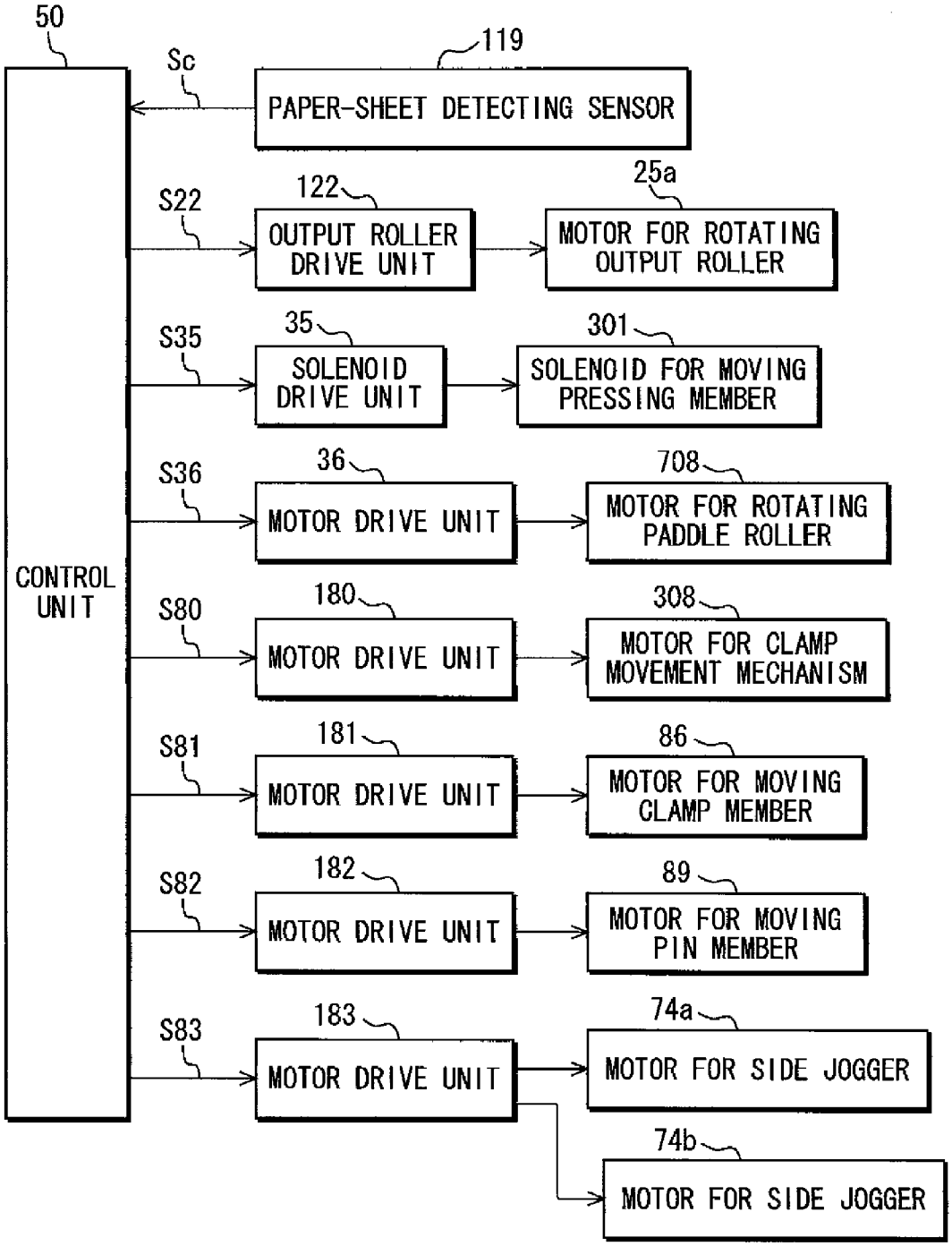
[FIG. 8] is a block diagram showing a configuration example of a control system of the binder paper alignment unit 30.

The following will describe a configuration example of a control system of the binder paper alignment unit 30 with reference to FIG. 8.

A solenoid drive unit 35, a motor drive unit 36, a output roller drive unit 122, and motor drive units 180 to 183 are connected to the control unit 50 shown in FIG. 8.

The solenoid drive unit 35 drives a solenoid 301 for moving pressing member and opens the immobilizing function by a right and left pressing members 304*a*, 304*b* when the paper proceeds, and controls rotatable guide portions 34*a*, 34*b* (which are not shown) so that the aforesaid pressing members 304*a*, 304*b* are functioned as driving guides for guiding the paper-sheet 3' to a paper-sheet reserving unit 32. By this control, the rotatable guide portions 34*a*, 34*b*, when the paper-sheet proceeding, opens pressing members 304*a*, 304*b* at both sides thereof and becomes the driving guide for guiding to the paper-sheet reserving unit 32.

Also, the solenoid drive unit 35 drives the solenoid 301 for moving pressing member, after the paper proceeding is completed, for example, at the time of binding process, closes the driving guide function by the pressing members 304*a*, 304*b*, and controls the rotatable guide portions 34*a*, 34*b* so that the aforesaid pressing members 304*a*, 304*b* are functioned as flat surface attachment components for holding down the rear end side of the paper-sheet 3' reserved in the paper-sheet reserving unit 32. By this control, the rotatable guide portions 34*a*, 34*b*, after the paper-sheet proceeding is completed, closes the driving guides and are made so as to be immobilized with both side portions of the rear end side of the paper-sheet 3' stored in the paper-sheet reserving unit 32.

The control unit 50, at least, controls an output of the solenoid drive unit 35 and drives the rotatable guide portions 34*a*, 34*b* in time divisional manner. For example, the control unit 50, when outputting the paper-sheet3' after the punching processing, outputs an output paper control signal S22 to the output roller drive unit 122. It is configured that the output roller drive unit 122 drives the motor 25*a* for rotating the output roller based on the output paper control signal S22 and outputs the paper-sheet 3' after the punching processing downward.

While the motor 25*a* for rotating the output roller is driven or for every drive thereof, the control unit 50 outputs a solenoid control signal S35 to the solenoid drive unit 35. It is configured that the solenoid drive unit 35 drives the solenoid 301 based on the solenoid control signal S35 and opens the immobilizing function by the pressing members 304*a*, 304*b*. Also, the solenoid drive unit 35, when the paper proceeds, drives the solenoid 301 based on the solenoid control signal S35 and comes to execute the immobilizing function by the pressing members 304*a*, 304*b*. Thus, it becomes possible to control the paper-sheet guide pressing mechanism 31.

It is configured that the motor drive unit 36 is connected to the control unit 50 and controls a paddle roller unit 37. The paddle roller unit 37 is provided with a motor 708 for rotating the paddle roller. For example, it is configured that the motor drive unit 36, to which the motor control signal S36 is inputted from the control unit 50, drives the motor 708 for rotating the paddle roller and controls the paddle roller unit 37.

It is configured that the motor drive units 180 to 182 are connected to the control unit 50 and control the clamp movement mechanism 80. The clamp movement mechanism 80 is provided with a motor 86 for moving the clamp member, a motor 89 for moving the guide member, and a motor 308 for the clamp movement mechanism. For example, it is configured that the motor drive unit 180, to which a movement control signal S80 is inputted from the control unit 50, drives the motor 308 for the clamp movement mechanism and performs movement-control on the clamp movement mechanism 80 to the paper-sheet transporting direction as shown in FIGS. 13 to 15.

It is configured that the motor drive unit 181, to which a movement control signal S81 is inputted from the control unit 50, drives the motor 86 for moving the clamp member and performs drive-control on the clamp members 82*a*, 82*b* shown in FIG. 6. It is configured that the motor drive unit 182, to which a movement control signal S82 is inputted from the control unit 50, drives the motor 89 for moving the pin member. It is configured that the motor drive unit 183, to which a movement control signal S83 is inputted from the control unit 50, is connected to the control unit 50 and drives motors 74*a*, 74*b* for side joggers.

It should be noted that the control unit 50 is preferable so as to execute the control based on the paper-sheet detection by a paper-sheet detecting sensor 119. The paper-sheet detecting sensor 119 counts the number of sheets of the paper-sheets 3' stored in the binder paper alignment unit 30 and outputs a paper-sheet detection signal Sc to the control unit 50. It is configured that the control unit 50 controls the clamp movement mechanism 80 and binding process unit 40 based on the inputted paper-sheet detection signal Sc.

Figure 9:
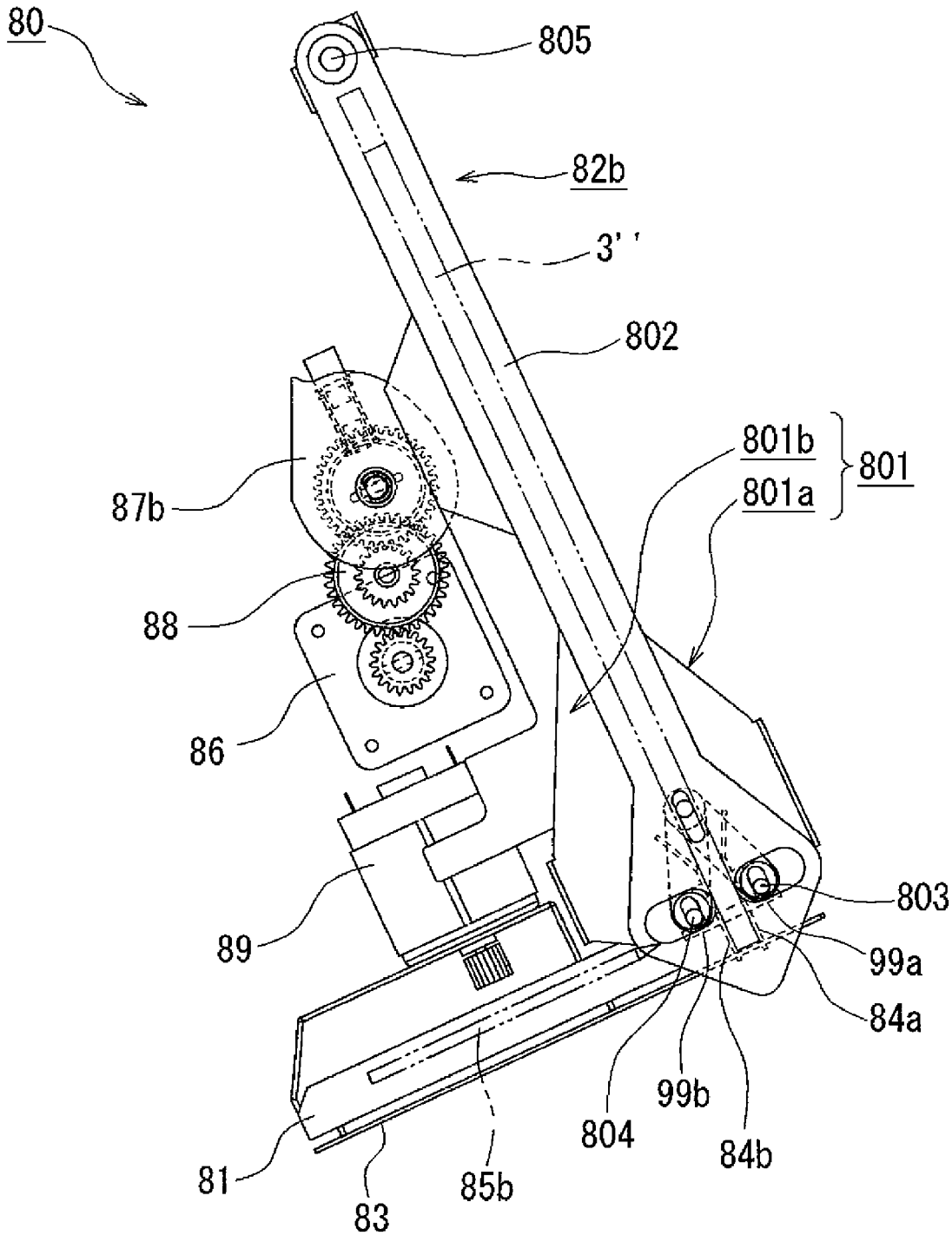
[FIG. 9] is a front elevational view showing an operation example (No. 1 thereof) at the time of alignment of a bundle of paper-sheets in the clamp movement mechanism 80.

The following will describe an operation example (No. 1 thereof) at the time of alignment of a bundle of paper-sheets in the clamp movement mechanism 80 with reference to FIG. 9. In this embodiment, it is assumed that the shutter 83 is closed, the paper-sheets 3' are stored in the paper-sheet reserving unit 32, and the bundle of paper-sheets 3" is held therein.

The clamp movement mechanism 80 shown in FIG. 9 is a standby state in which the alignment pin 85*b* is not inserted into the bundle of paper-sheets 3" of defined number of sheets and is a state in which the bundle of paper-sheets 3" is held with the clamp members 82*a* (that is not shown), 82*b*. For example, the clamp member 82*a* and clamp member 82*b* execute the clamp operation based on the fulcrum axis member 805 in the rear end thereof while receiving the restriction to the connecting rods 803, 804 mounted on the clip-shaped member 801 by the member 802 with a restriction hole in the front end thereof.

Further, the connecting rods 803, 804 are movable a little bit in the vertical direction with respect to the clamp operation direction by the clip-shaped member 801. This is because positioning is carried out by pushing the respective binding component guide members 99*a*, 99*b* mounted on the connecting rods 803, 804 up to a predetermined position by the alignment pins 85*a*, 85*b* from a state in which it is positioned in its lowermost portion by self-weight.

In the embodiment, the comb shaped upper portion pressing member 84*a* mounted on the connecting rod 803 through the binding component guide member 99*a* and the comb shaped lower portion pressing member 84*b* mounted on the connecting rod 804 through the binding component guide member 99*b* hold the bundle of paper-sheets 3". Further, the binding component guide member 99*a* mounted on the connecting rod 803 and the binding component guide member 99*b* mounted on the connecting rod 804 guide the binding component 43 to the punch holes of the bundle of paper-sheets 3". In the present stage, positioning of the binding component guide members 99*a*, 99*b* to the punch holes of the bundle of paper-sheets 3" is not carried out.

At that time, the cams 87*a* (that is not shown), 87*b* take a predetermined posture at the first position (home position). For example, it is a state in which protrusive portions of the cams 87*a*, 87*b* are facing just above. It should be noted that the motor 89 in the drawing is a motor for driving the alignment pins. The motor 89 and the alignment pins 85*a* (which is not shown), 85*b* are engaged by the link mechanism, which is not shown. The link mechanism functions so as to convert rotational movement of the motor 89 to reciprocating movement.

Figure 10:
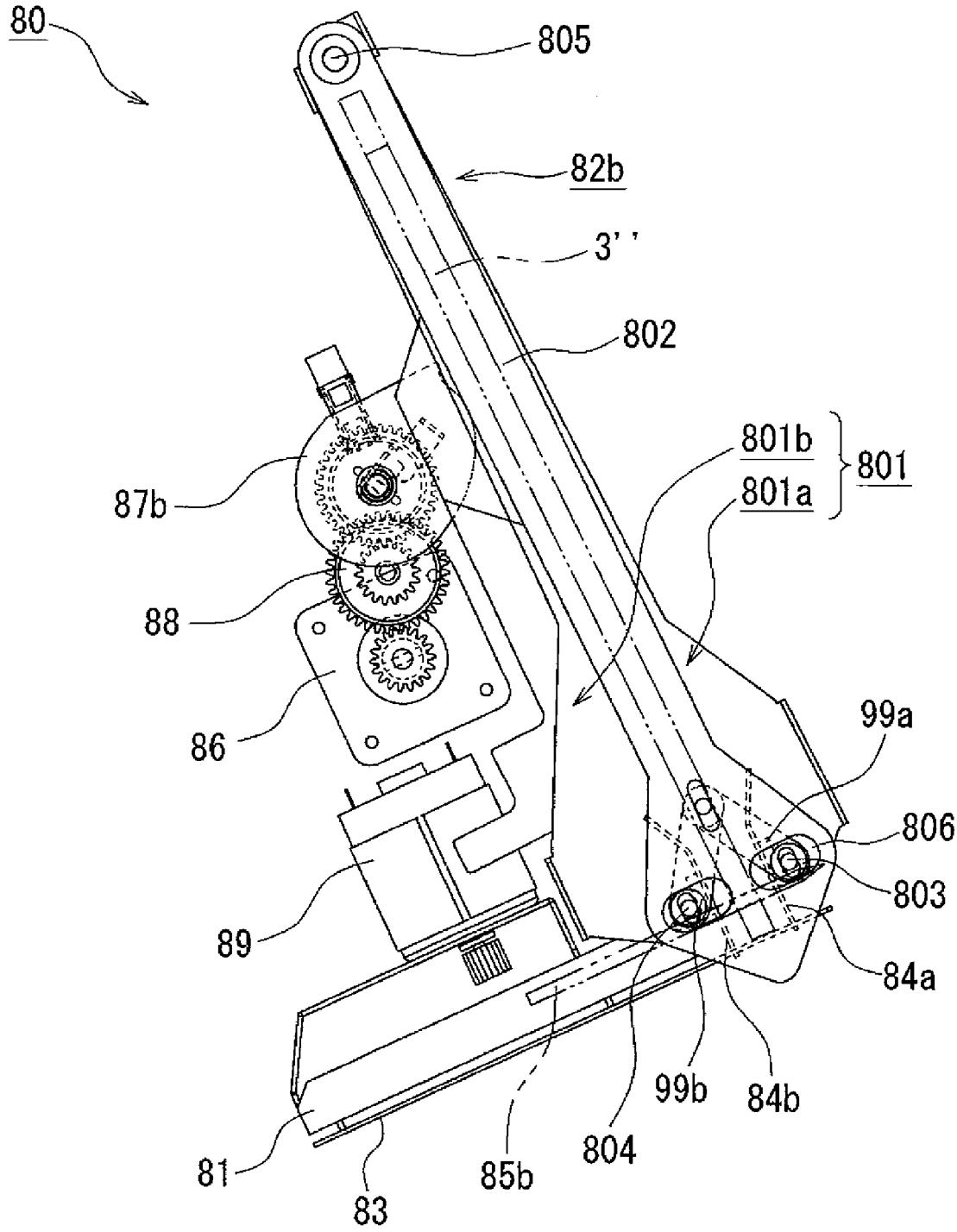
[FIG. 10] is a front elevational view showing an operation example (No. 2 thereof) at the time of alignment of a bundle of paper-sheets in the clamp movement mechanism 80.

The following describe an operation example (No. 2 thereof) at the time of alignment of the bundle of paper-sheets in the clamp movement mechanism 80 with reference to FIG. 10. In this embodiment, it is assumed that, as shown in FIG. 9, the shutter 83 is closed, the paper-sheet 3' is stored in the paper-sheet reserving unit 32, and the bundle of paper-sheets 3" of defined number of sheets is held by the clamp members 82*a* (which is not shown), 82*b*.

The clamp movement mechanism 80 shown in FIG. 10 is a state in which in order to align the positions of the punch holes of the bundle of paper-sheets 3", the clamp members 82*a* (which is not shown), 82*b* are opened with the shutter 83 being closed and the alignment pin 85*a* (that is not shown), 85*b* are inserted into predetermined punch holes of the bundle of paper-sheets 3". For example, the motor 86 converts the motor rotational frequency by a predetermined gear ratio through the gear unit 88 and transmits the motor rotational force to the cams 87*a* (which is not shown) and 87*b*. As a result thereof, the cams 87*a* and 87*b* become in a state in which they rotate clockwise by 90 degrees from their first position.

At that time, it is configured that owing to a fact that, in the respective clamp members 82*a* (which is not shown), 82*b*, the protrusive portions of the cams 87*a* and 87*b* are depressed on the cam operative regions of the movable member 801*a* and 801*b*, the clip-shaped members 801 of the respective clamp members 82*a*, 82*b* are opened synchronously.

In the clip-shaped member 801, the movable member 801*a* and the movable member 801*b* operate so as to open by making the fulcrum axis member 805 to be a movable reference. The movements of the movable members 801*a*, 801*b* are restricted by the elongated opening portion 806 of the member 802 with a restriction hole and the clamp open width of the clip-shaped member 801 is restricted. The driving force is transmitted to the connecting rod 803 mounted on the movable member 801*a* movably and the connecting rod 804 mounted on the movable member 801*b* movably.

As a result thereof, the comb shaped upper portion pressing member 84*a* mounted on the connecting rod 803 and the comb shaped lower portion pressing member 84*b* mounted on the connecting rod 804 release the bundle of paper-sheets 3" to be free. When these clamp members 82*a*, 82*b* make the bundle of paper-sheets 3" to be in a freely released state, it is possible to stop the free fall of the bundle of paper-sheets 3" owing to a fact that the shutter 83 is closed.

Then, it is configured that the motor 89 is driven, the positive rotational movement of the motor 89 is converted to upward movement of the pin by a link mechanism, which is not shown, and the alignment pin 85*b* is inserted into the punch hole of the bundle of paper-sheets 3". This enables the positions of the punch holes of the bundle of paper-sheets 3" to be aligned.

Further, the positioning is carried out by pushing the respective binding component guide members 99*a*, 99*b* mounted on the connecting rods 803, 804 up to a predetermined position by the alignment pins 85*a*, 85*b* from a state in which they are positioned at their lowermost portion by their self-weight.

Figure 11:
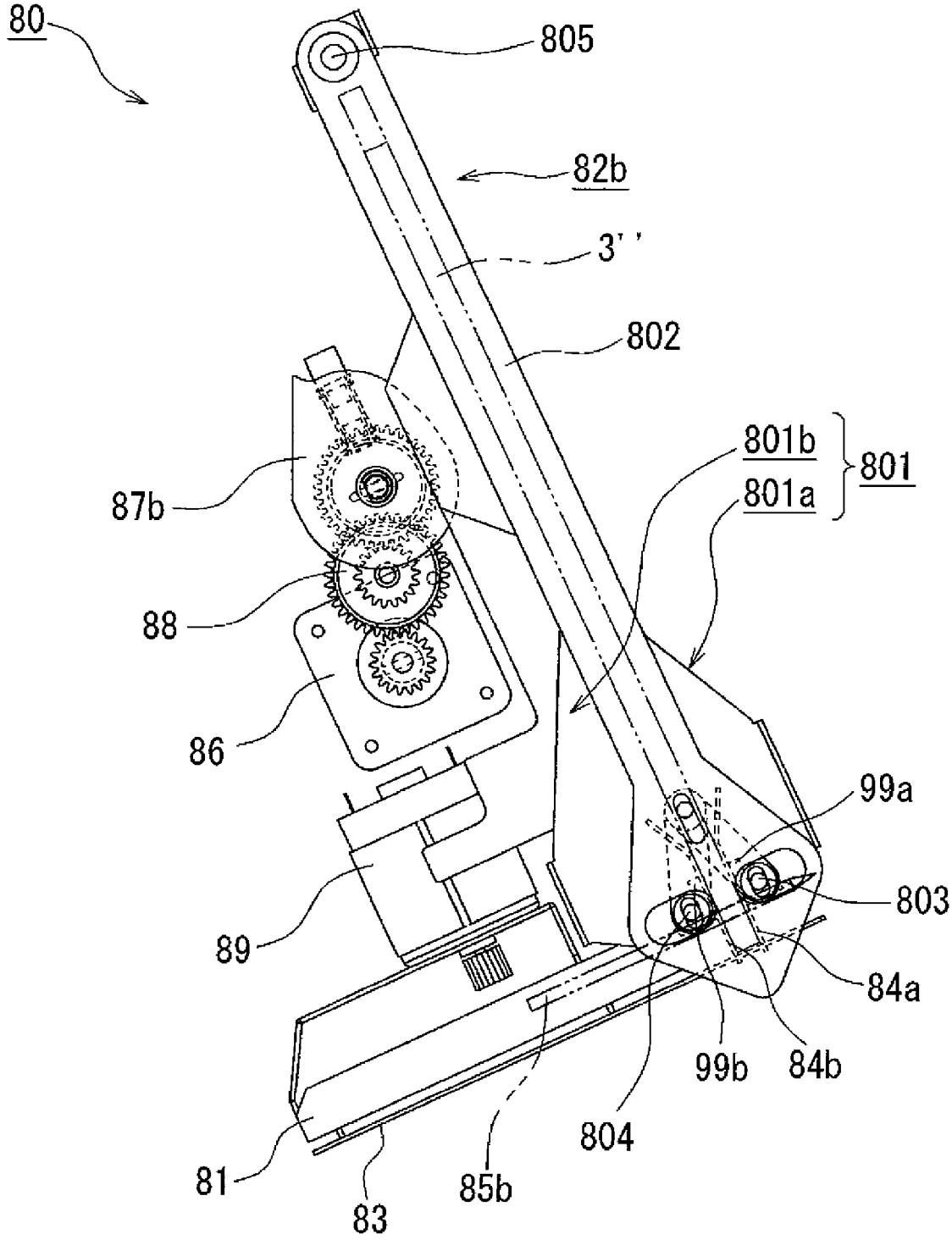
[FIG. 11] is a front elevational view showing an operation example (No. 3 thereof) at the time of alignment of a bundle of paper-sheets in the clamp movement mechanism 80.

The following will describe the operation example (No. 3 thereof) at the time of alignment of the bundle of paper-sheets in the clamp movement mechanism 80 with reference to FIG. 11. In this embodiment, as shown in FIG. 10, it is assumed that the shutter 83 is closed, the bundle of paper-sheets 3" is stored in the paper-sheet reserving unit 32, the bundle of paper-sheets 3" of defined number of sheets is freely released by the clamp members 82*a* (which is not shown), 82*b*, and the alignment pin 85*b* is fitted to the punch hole of the bundle of paper-sheets 3".

The clamp movement mechanism 80 shown in FIG. 11 is a state in which the alignment pin 85*b* is inserted into a predetermined punch hole of the bundle of paper-sheets 3" and it is clamp-locked again.

Owing to the clamp movement mechanism 80 shown in FIG. 11, the cams 87*a* (which is not shown), 87*b* return from the second position (clamp open) to the first position (home position) and take a predetermined posture. For example, the motor 86 rotates reversely, converts the motor rotational frequency by a predetermined gear ratio through the gear unit 88, and transmits the motor rotational force to the cams 87*a* and 87*b*. As a result thereof, the cams 87*a* and 87*b* become a state in which they rotate counterclockwise by 90° from the second position.

At that time, it is configured that owing to a state such that, in the respective clamp members 82*a* and 82*b*, the protrusive portions of the cams 87*a* and 87*b* are not depressed to the cam operative region of the movable member 801*a* and 801*b*, the clip-shaped members 801 of the respective clamp members 82*a* and 82*b* are synchronously closed by a spring, which is not shown, connecting the movable members 801*a* and 801*b*.

In the clip-shaped member 801, the movable member 801*a* and the movable member 801*b* operate so as to close by making the fulcrum axis member 805 to be the movable reference. The driving force is transmitted to the connecting rod 803 mounted on the movable member 801*a* movably and the connecting rod 804 mounted on the movable member 801*b* movably. As a result thereof, the comb shaped upper portion pressing member 84*a* mounted on the connecting rod 803 and the comb shaped lower portion pressing member 84*b* mounted on the connecting rod 804 hold and fix the bundle of paper-sheets 3".

Further, the positioning completes by pushing the respective binding component guide members 99*a*, 99*b* mounted on the connecting rods 803, 804 up to a predetermined position by the alignment pins 85*a*, 85*b* from a state in which they are positioned at the lowermost portion by self-weight.

Figure 12:
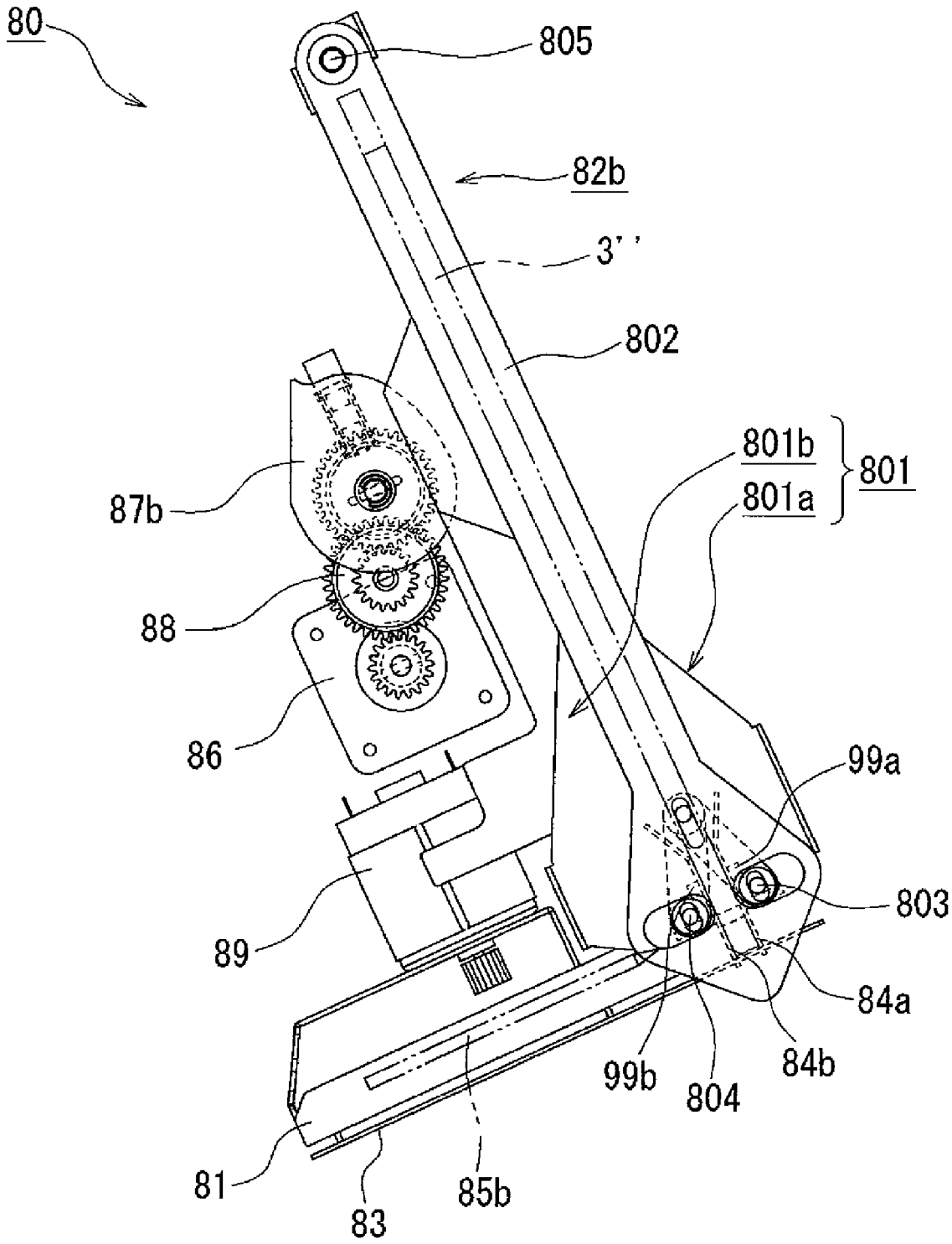
[FIG. 12] is a front elevational view showing an operation example (No. 4 thereof) at the time of alignment of a bundle of paper-sheets in the clamp movement mechanism 80.

The following will describe the operation example (No. 4 thereof) at the time of alignment of the bundle of paper-sheets in the clamp movement mechanism 80 with reference to FIG. 12. In this embodiment, as shown in FIG. 11, it is assumed that the shutter 83 is closed, the bundle of paper-sheets 3" is stored in the paper-sheet reserving unit 32, the alignment pin 85*b* is inserted into the punch holes of the bundle of paper-sheets 3" in the bundle of paper-sheets 3" of defined number of sheets, and it is held and fixed by the clamp members 82*a* (which is not shown), 82*b*.

The clamp movement mechanism 80 shown in FIG. 12 is a state in which the alignment pin 85*b* is pulled out from the predetermined punch hole of the bundle of paper-sheets 3" and the clamp-lock is maintained.

According to the clamp movement mechanism 80 shown in FIG. 12, it is keeping posture of the first position (home position). It is configured that the motor 89 is driven and by the link mechanism, which is not shown, the reverse rotational movement of the motor 89 is converted to the downward movements of the alignment pins 85*a*, 85*b* so that the alignment pins 85*a*, 85*b* can be pulled out from the punch holes of the bundle of paper-sheets 3". This enables, before the binding process, positions of the punch holes of the bundle of paper-sheets 3" to be aligned, and the bundle of paper-sheets 3" to be also held and fixed with the positions of the binding component guide members 99*a*, 99*b* being aligned.

During this period of time, the shutter 83 operates so as to limit the paper output of the bundle of paper-sheets 3" stored in the paper-sheet reserving unit 32 and thereafter, it is opened so as to slide in a direction perpendicular to the transporting direction of the bundle of paper-sheets 3".

Figure 13A:
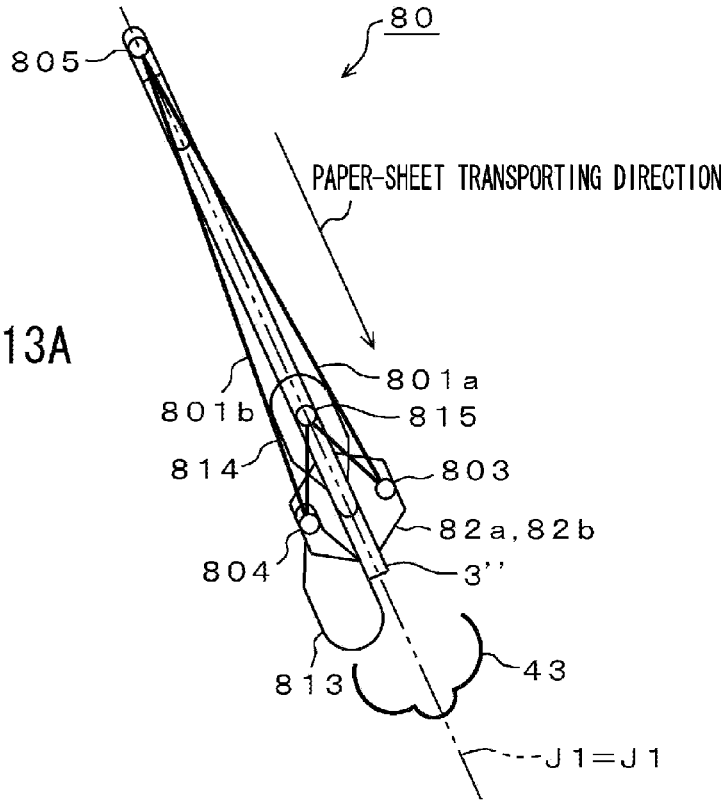
[FIG. 13A] is a conceptional diagram showing a state before the descent of a downward movement adjustment example of the clamp movement mechanism 80 in case of standard number of sheets.
Figure 13B:
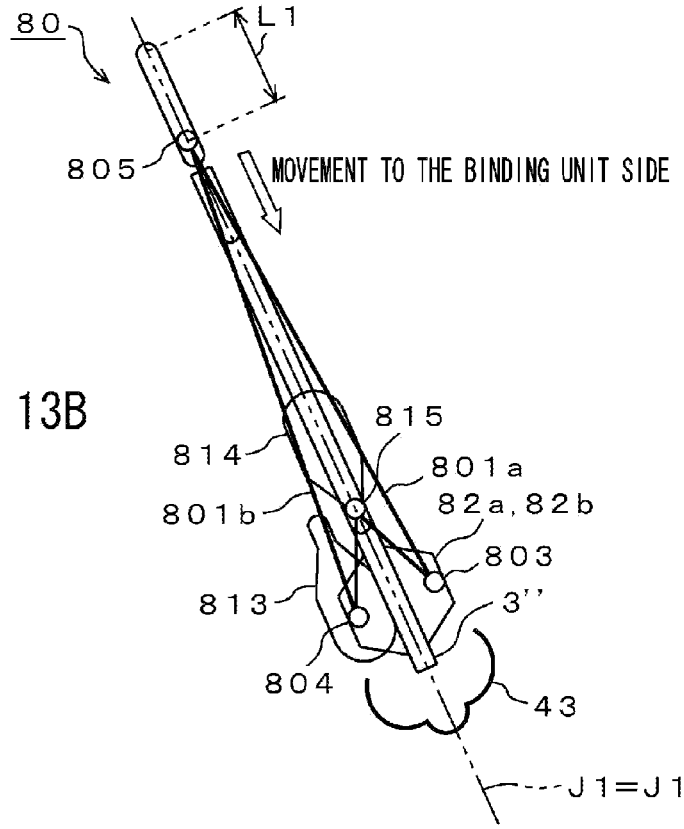
[FIG. 13B] is a conceptional diagram showing a state after the descent of downward movement adjustment example of the clamp movement mechanism 80 in case of standard number of sheets.

The following will describe an example of downward movement adjustment of the clamp movement mechanism 80 (at the time of a standard number of sheets) with reference to FIGS. 13A and 13B.

The clamp movement mechanism 80 shown in FIG. 13A is provided with an opening portion 813 for determining the clamp position. The opening portion 813 has a bottle cross-section shape. It is configured that the clamp position is determined by a fact that the connecting rod 804 falls into a portion corresponding to the bottle neck portion at this opening portion 813.

The clamp movement mechanism 80 is provided with an opening portion 814 for correction other than the opening portion 813. The opening portion 814 for correction is a portion for making correction from the paper-sheet transport center position of the bundle of paper-sheets 3" at the time of thin number of sheets to the paper-sheet transport center position at the time of standard number of sheets and from the paper-sheet transport center position of the bundle of paper-sheets 3" at the time of thick number of sheets to the paper-sheet transport center position at the time of standard number of sheets. A post 815 in the opening portion 814 for correction is a movable axis for engaging link members of the clamp members 82*a*, 82*b*.

The clamp members 82*a*, 82*b* hold the bundle of paper-sheets 3" of the standard number of sheets and move to the downstream side along the paper-sheet transporting direction in a state of holding bundle of paper-sheets 3" with respect to the main body substrate 81 shown in FIG. 6. In this case, it is designed such that the paper-sheet transport center position and the binding center position of the binding component 43 will coincide. Here, the paper-sheet transporting direction center position means a position dividing the thickness of the bundle of paper-sheets 3" by ½ in the thickness direction thereof. Also, the binding center position means a position of the backbone of the binding component 43. Consequently, in a case in which the bundle of paper-sheets 3" has a standard number of sheets, the downward movement adjustment is omitted.

In this embodiment, the clamp members 82*a*, 82*b* descend directed to a center of the binding component 43 of the half-bound state as shown in FIG. 13B, which the binding process unit 40 provides, with the clamp movement mechanism 80 clamping the bundle of paper-sheets 3". The clamp members 82*a*, 82*b* descend (move) to the binding unit side by an offset distance L1 shown in the drawing by making the home position of the fulcrum axis member 805 to be a reference.

The clamp movement mechanism 80 operates during the descent of these clamp members 82*a*, 82*b* such that the paper-sheet transport center position and the binding center position will coincide. Thereafter, it is configured that when the punch holes of the bundle of paper-sheets 3" reach the center of the binding component 43 in the half-bound state, the binding component 43 is bind-processed by the binding process unit 40. This enables the punch holes of the bundle of paper-sheets 3" to be bound with the binding component 43.

Figure 14A:
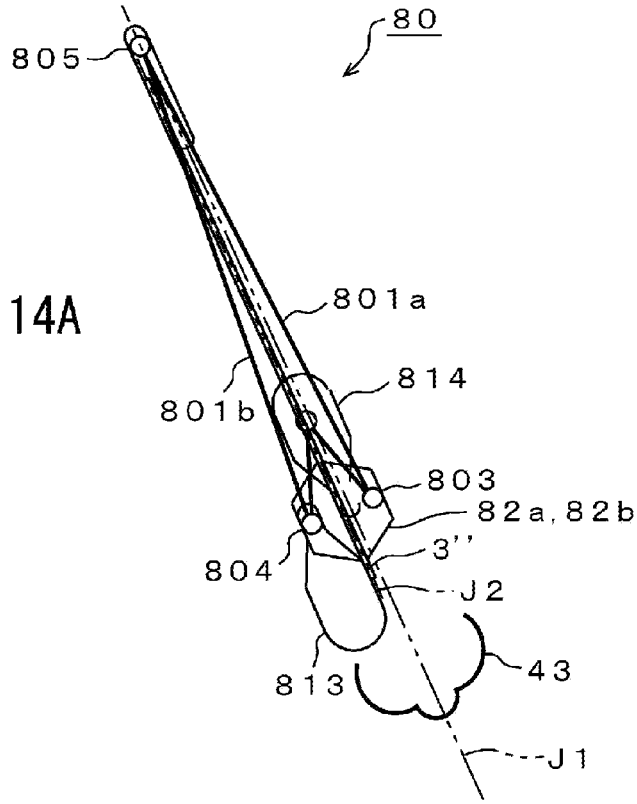
[FIG. 14A] is a conceptional diagram showing a state before the descent of a downward movement adjustment example of the clamp movement mechanism 80 in case of thin number of sheets.
Figure 14B:
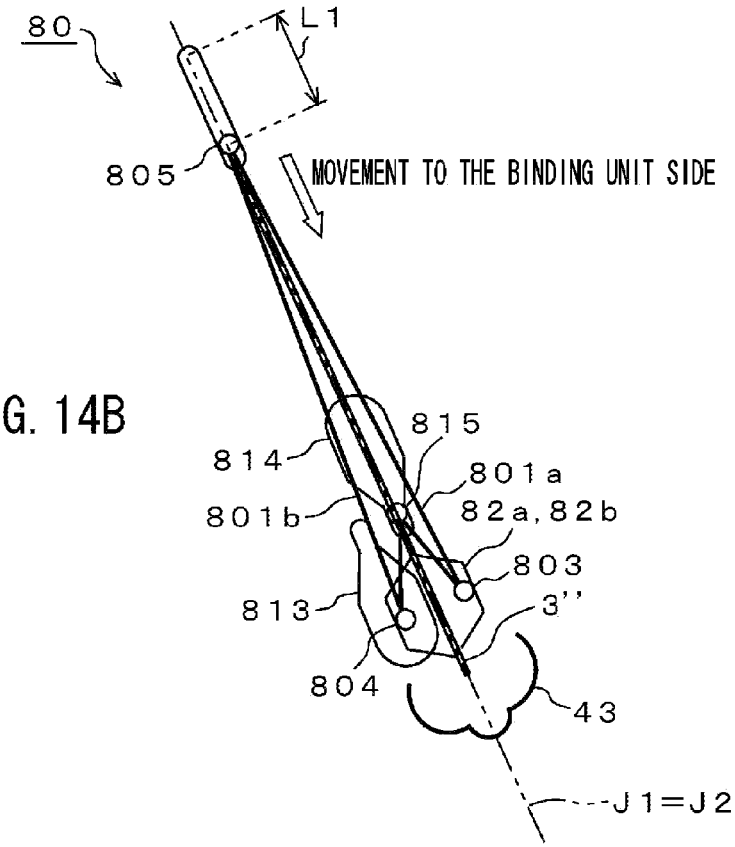
[FIG. 14B] is a conceptional diagram showing a state after the descent of a downward movement adjustment example of the clamp movement mechanism 80 in case of thin number of sheets.

The following will describe a downward movement adjustment example of the clamp movement mechanism 80 (at the time of thin number of sheets) with reference to FIGS. 14A and 14B.

The clamp members 82*a*, 82*b* shown in FIG. 14A hold the bundle of paper-sheets 3" of thinner number of sheets than the standard number of sheets and are in a case of moving to the downstream side along the paper-sheet transporting direction in a state of holding the bundle of paper-sheets 3" with respect to the main body substrate 81 shown in FIG. 6. In this case, the paper-sheet transport center position of the bundle of paper-sheets 3" at the time of thin number of sheets is out of alignment to the left side (bottom portion side of the paper-sheet reserving unit 32) compared with the paper-sheet transport center position at the time of standard number of sheets. If this state is maintained, it does not coincide with the binding center position of the binding component 43.

Consequently, the opening portion 814 for correction functions so as to correct the paper-sheet transport center position of the bundle of paper-sheets 3" at the time of thin number of sheets to the paper-sheet transport center position at the time of standard number of sheets. The opening portion 814 for correction functions so as to shift the front edge of the bundle of paper-sheets from the right side to the left side by utilizing the bottle cross-section shape thereof. Owing to the function of this opening portion 814 for correction, the clamp members 82*a*, 82*b* descend directed to the center of the binding component 43 in the half-bound state as shown in FIG. 14B while changing the posture from the paper-sheet transport center position of the bundle of paper-sheets 3" at the time of thin number of sheets to the paper-sheet transport center position thereof at the time of standard number of sheets. At a point of time when these clamp members 82*a*, 82*b* complete the descent, the clamp movement mechanism 80 operates such that the paper-sheet transport center position of the bundle of paper-sheets 3" at the time of thin number of sheets will coincide with the binding center position. Thereafter, it is configured that the binding component 43 is bind-processed similarly as FIG. 13B. This enables the bundle of paper-sheets 3" to be bound even if the bundle of paper-sheets 3" has thinner number of sheets than the standard number of sheets.

Figure 15A:
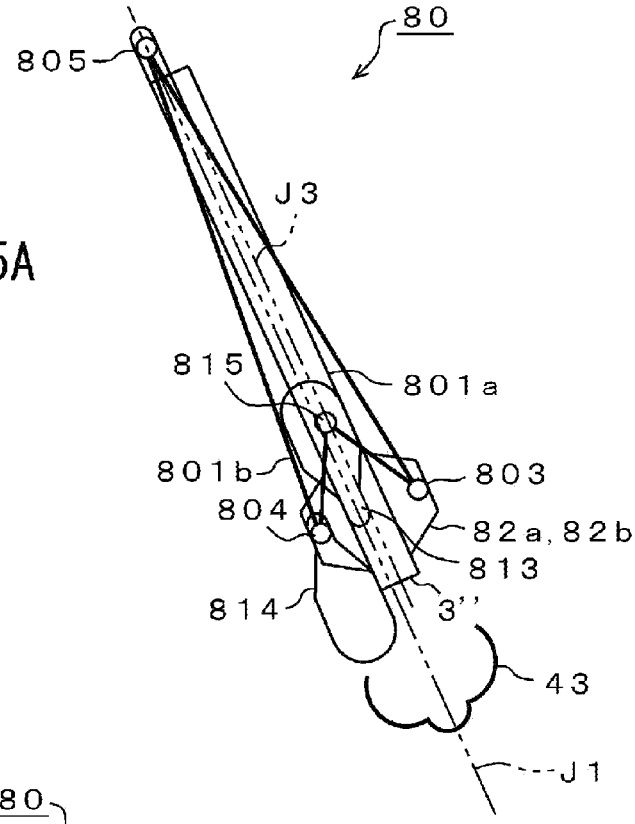
[FIG. 15A] is a conceptional diagram showing a state before the descent of a downward movement adjustment example of the clamp movement mechanism 80 in case of thick number of sheets.
Figure 15B:
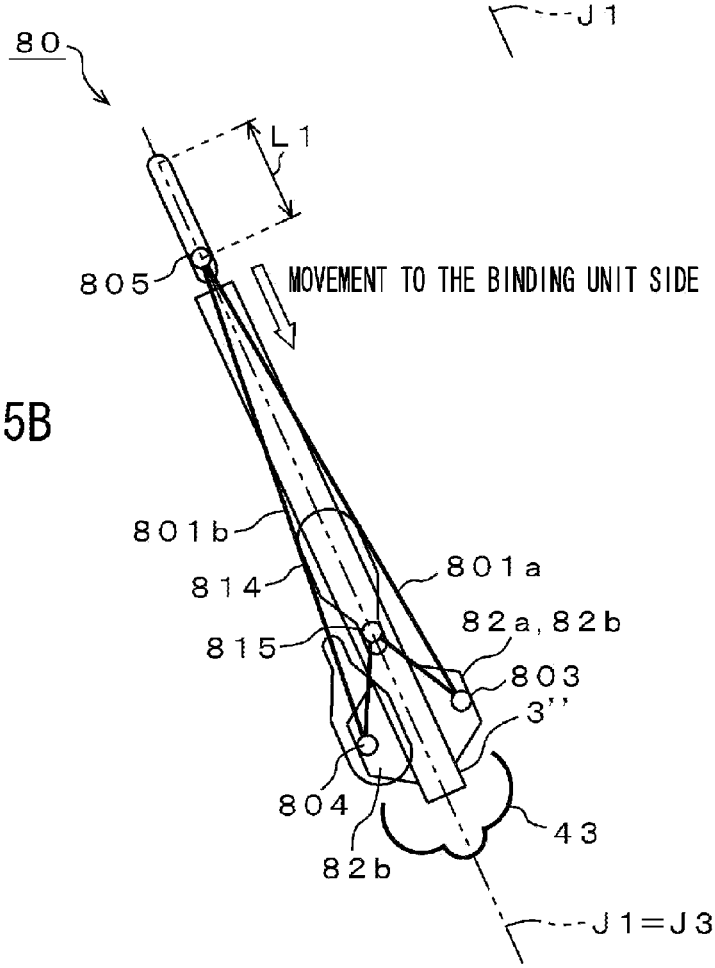
[FIG. 15B] is a conceptional diagram showing a state after the descent of a downward movement adjustment example of the clamp movement mechanism 80 in case of thick number of sheets.

The following will describe the downward movement adjustment example of the clamp movement mechanism 80 (at the time of thick number of sheets) with reference to FIGS. 15A and 15B.

The clamp members 82*a*, 82*b* shown in FIG. 15A hold the bundle of paper-sheets 3" of thicker number of sheets than the standard number of sheets and are in a case of moving to the downstream side along the paper-sheet transporting direction in a state of holding the bundle of paper-sheets 3" with respect to the main body substrate 81 shown in FIG. 6. In this case, the paper-sheet transport center position of the bundle of paper-sheets 3" at the time of thick number of sheets is out of alignment to the right side (upper portion side of the paper-sheet reserving unit 32) compared with the paper-sheet transport center position at the time of standard number of sheets. If this state is maintained, it does not coincide with the binding center position of the binding component 43.

Consequently, the opening portion 814 for correction functions so as to correct the paper-sheet transport center position of the bundle of paper-sheets 3" at the time of thicker number of sheets to the paper-sheet transport center position at the time of standard number of sheets. The opening portion for correction functions so as to shift the front edge of the bundle of paper-sheets from the left side to the right side by utilizing the bottle cross-section shape thereof. Owing to the function of this opening portion 814 for correction, the clamp members 82*a*, 82*b* descend directed to the center of the binding component 43 in the half-bound state as shown in FIG. 15B while changing the posture from the paper-sheet transport center position of the bundle of paper-sheets 3" at the time of thicker number of sheets to the paper-sheet transport center position at the time of standard number of sheets. At a point of time when these clamp members 82*a*, 82*b* complete the descent, the crank movement mechanism 80 operates such that the paper-sheet transport center position of the bundle of paper-sheets 3" at the time of thicker number of sheets will coincide with the binding center position. Thereafter, it is configured that the binding component 43 is bind-processed similarly as FIG. 14B. This enables the bundle of paper-sheets 3" to be bound even if the bundle of paper-sheets 3" has thicker number of sheets than the standard number of sheets.

Subsequently, the movement mechanism 41 that holds and fixes the binding component 43 will be explained.

Figure 16A:
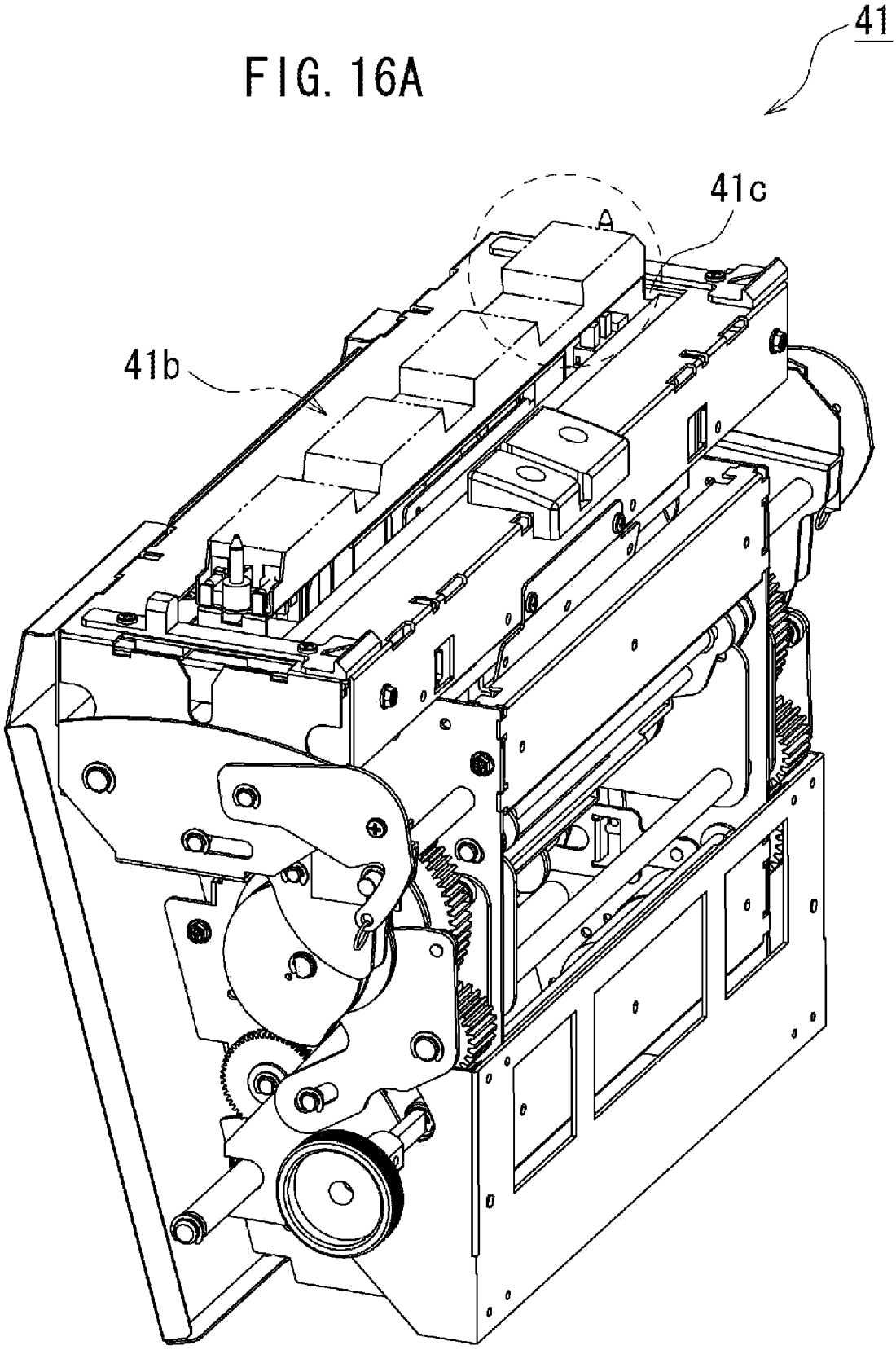
[FIG. 16A] is a perspective view showing a configuration example of movement mechanism 41.
Figure 16B:
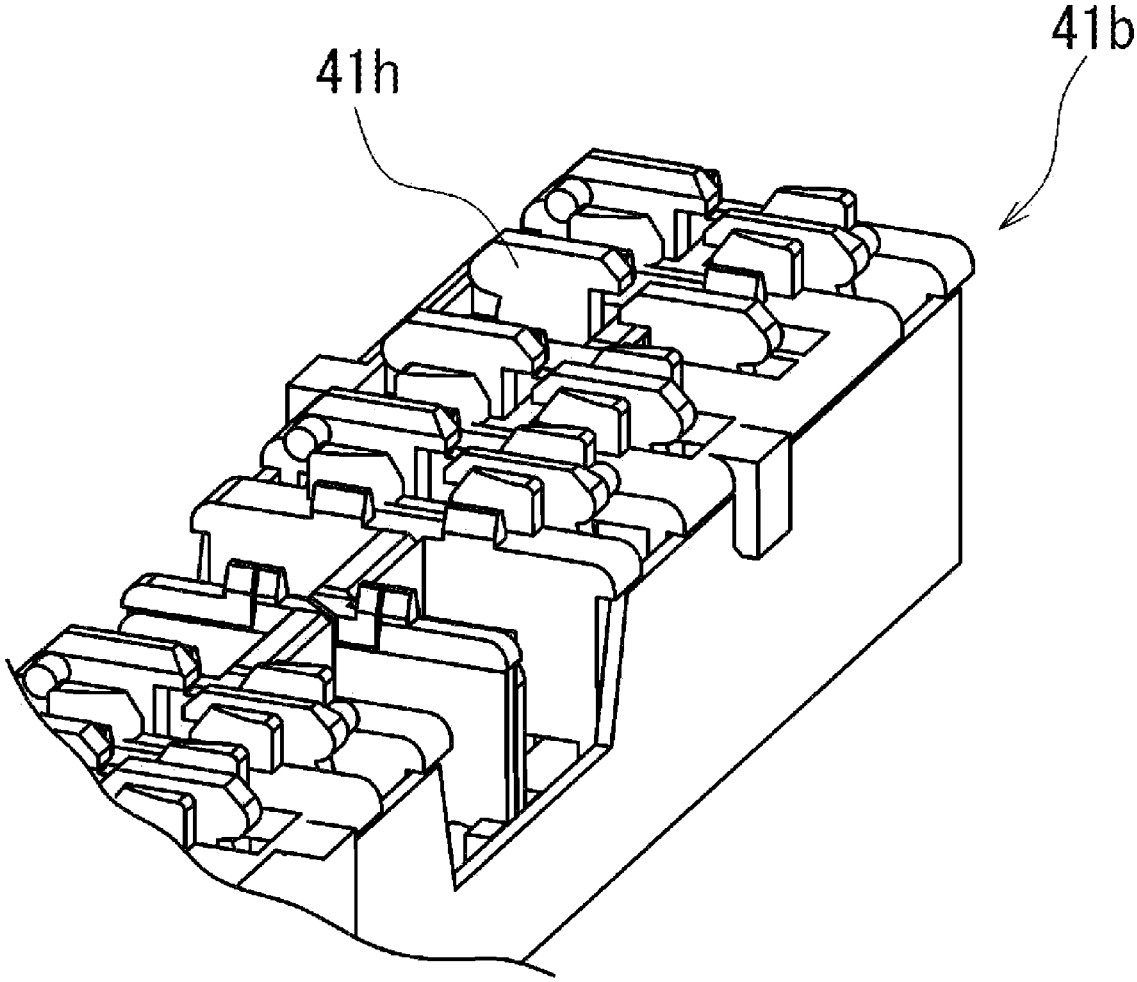
[FIG. 16B] is a perspective view showing a configuration example of an upper edge portion of a binding component gripping portion 41*b* by enlarging the inside of the dotted circle shown in FIG. 16A.

The following will describe a configuration example of the movement mechanism 41 in the binding process unit 40 with reference to FIG. 16A and a configuration example of an upper edge portion of the binding component gripping portion 41*b* with reference to FIG. 16B. The movement mechanism 41 shown in FIG. 16A has an opening portion 41*c* and the binding component gripping portion 41*b*. The binding component gripping portion 41*b* shown in FIG. 16B is constituted such that it holds the binding component 43 of a predetermined size in a state of development and is adjustable upward and downward in conformity with the size of diameter of the binding component 43. The binding component gripping portion 41*b* moves up and down and acquires the binding component 43 (which is not shown) stacked in the binder cassette 42 shown in FIG. 3. For example, when the movement mechanism 41 is a waiting state that is the state before acquiring the binding component 43, the binding component gripping portion 41*b* is positioned inside of the movement mechanism 41 and when the waiting state is released, namely, in a case in which the plurality of paper-sheets stored in the paper alignment unit 30 shown in FIG. 3 reach the defined number of sheets and the binding component 43 is inserted thereinto, the binding component gripping portion 41*b* positioned inside of the movement mechanism 41 moves upward to the outside of the movement mechanism 41 from the opening portion 41*c* and acquires the binding component 43.

Figure 17:
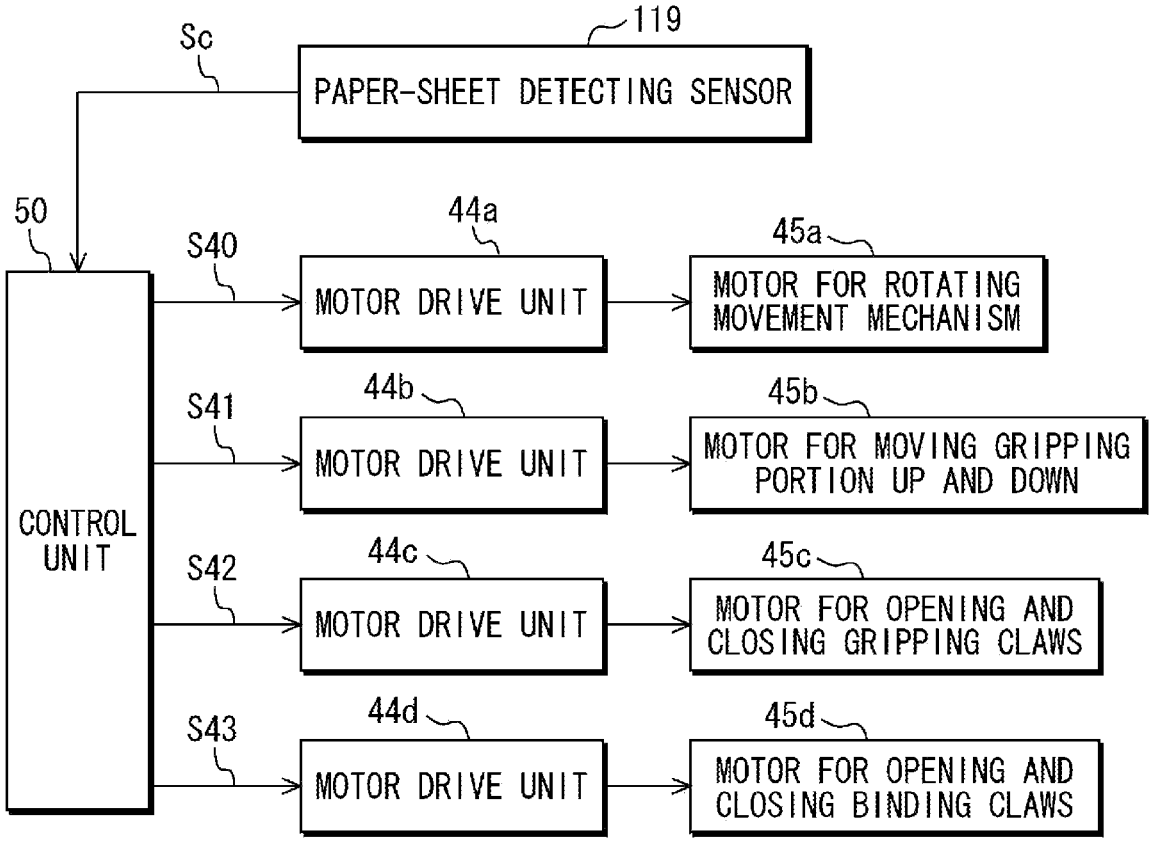
[FIG. 17] is a block diagram showing a configuration example of a control system of the binding process unit 40.

The following will describe a configuration example of a control system of the binding process unit 40 with reference to FIG. 17. The control unit 50 shown in FIG. 17 is constituted by including, for example, a CPU (Central process unit), which is not shown, a memory and the like. The control unit 50 is connected with motor drive units 44*a*, 44*b*, 44*c* and 44*d*. The control unit 50 controls the motor drive units 44*a*, 44*b*, 44*c* and 44*d* based on an output of the paper-sheet detecting sensor 119.

For example, the control unit 50 is shifted to the binding component acquisition of the binding component 43 and the binding control when the paper-sheet detection signal Sc to the effect that one sheet of the paper-sheet 3' has detected is inputted from the paper-sheet detecting sensor 119.

The motor drive unit 44*a* is connected to the control unit 50, drives the motor 45*a* for rotating the movement mechanism based on a motor control signal S40, and on the axis of the movement mechanism rotating axes 41*d* shown in FIG. 3 and FIG. 4, rotates the movement mechanism 41 to the A directions in the drawings. The motor drive unit 44*b* is connected to the control unit 50, drives the motor 45*b* for moving the gripping portion up and down based on a motor control signal S41, and drives the binding component gripping portion 41*b* shown in FIG. 16B upward and downward.

The motor drive unit 44*c* is connected the control unit 50, drives a motor 45*c* for opening and closing the gripping claws based on a motor control signal S42, and drives a binding component gripping claws 41*h* shown in FIG. 16B so as to be opened or closed. The motor drive unit 44*d* is connected to the control unit 50, drives a motor 45*d* for opening and closing the binding claws based on a motor control signal S43, and drives binding claws 41*k* shown in FIG. 21A so as to be opened or closed.

Figure 18A:
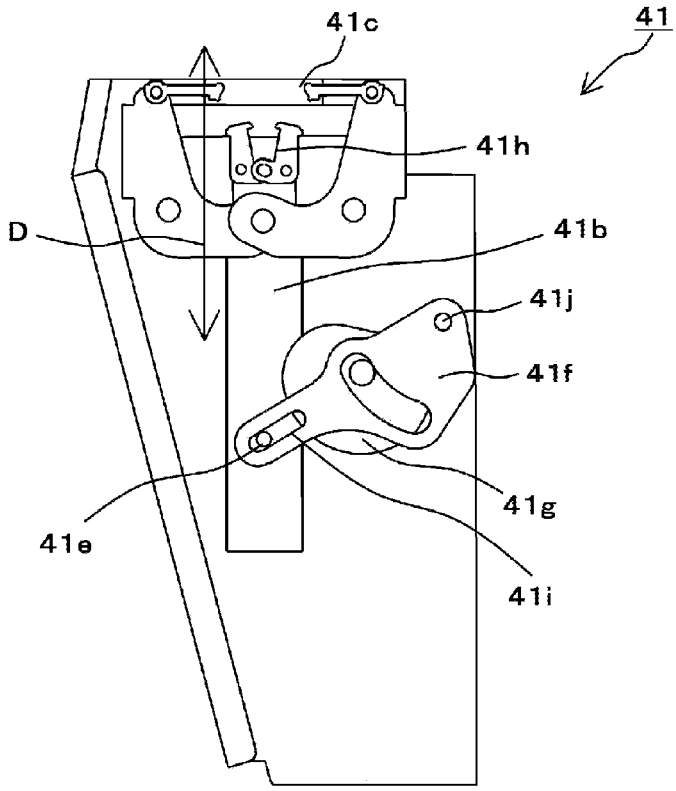
[FIG. 18A] is a schematic diagram of a cross section showing a state example in which the binding component gripping portion 41*b* of a movement mechanism 41 is positioned at the lowermost portion.
Figure 18B:
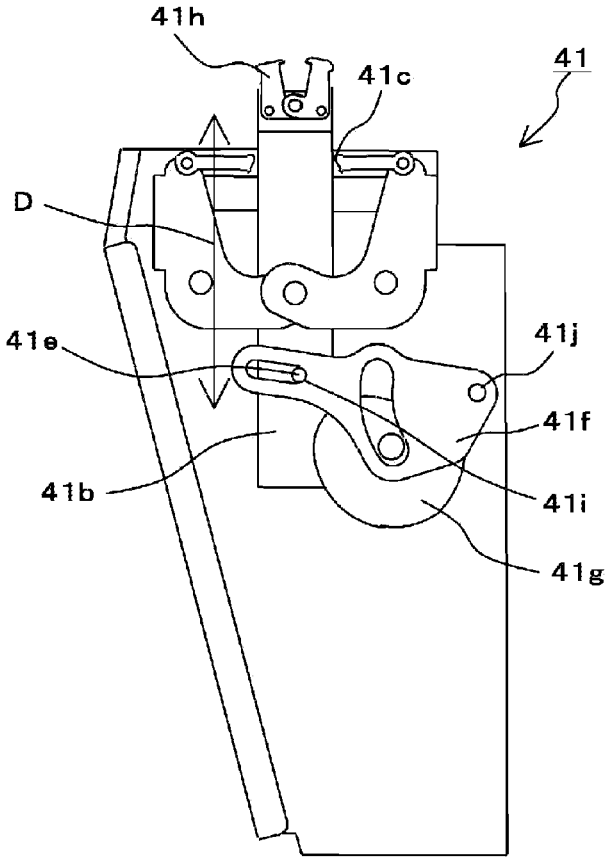
[FIG. 18B] is a schematic diagram of a cross section showing a state example in which the binding component gripping portion 41*b* is positioned at the uppermost portion.

The following will describe a configuration example of the movement mechanism 41 with reference to FIG. 18A and FIG. 18B. The movement mechanism 41 shown in FIG. 18A shows a state in which the binding component gripping portion 41*b* is positioned at the lowermost portion and the movement mechanism 41 shown in FIG. 18B shows a state in which the binding component gripping portion 41*b* is at the uppermost portion. In order to carry out the up and down movement of the binding component gripping portion 41*b*, the movement mechanism 41 has the binding component gripping portion 41*b*, the opening portion 41*c*, a gripping portion link coupling portion 41*e*, a gripping portion link 41*f*, a cam 41*g* for the gripping portion, and a gripping portion coupling hole 41*i*. The binding component gripping portion 41*b* has plural binding component gripping claws 41*h* at the upper edge portion thereof and the binding component gripping claws 41*h* are used as a grip for the binding component 43 when acquiring any one of the binding components 43 stacked in the binder cassette 42 shown in FIG. 3.

The binding component gripping portion 41*b* has a convexity shaped gripping portion link coupling portion 41*e* in a side surface thereof. It is constituted with a state in which the gripping portion link coupling portion 41*e* is inserted into a slot-shaped gripping portion coupling hole 41*i* of the gripping portion link 41*f* and the binding component gripping portion 41*b* and the gripping portion link 41*f* are connected. It is constituted such that the gripping portion link 41*f* is jointed to a cam 41*g* for the gripping portion and is rotatable on the axis of a gripping portion link rotating axis 41*j* by rotating the cam 41*g* for the gripping portion.

Position and posture of the gripping portion coupling hole 41*i* are changed by rotating the cam 41*g* for the gripping portion to rotate the gripping portion link 41*f*, and consequently, the binding component gripping portion 41*b* moves up and down through the gripping portion link coupling portion 41*e* as shown in an arrow D.

The control of the up and down movement of the binding component gripping portion 41*b* is carried out by inputting the motor control signal S41 outputted from the control unit 50 shown in FIG. 17 to the motor drive unit 44*b* and causing the motor drive unit 44*b* thus inputted to drive the motor 45*b* for moving the gripping portion up and down and the cam 41*g* for the gripping portion to rotate.

Figure 19A:
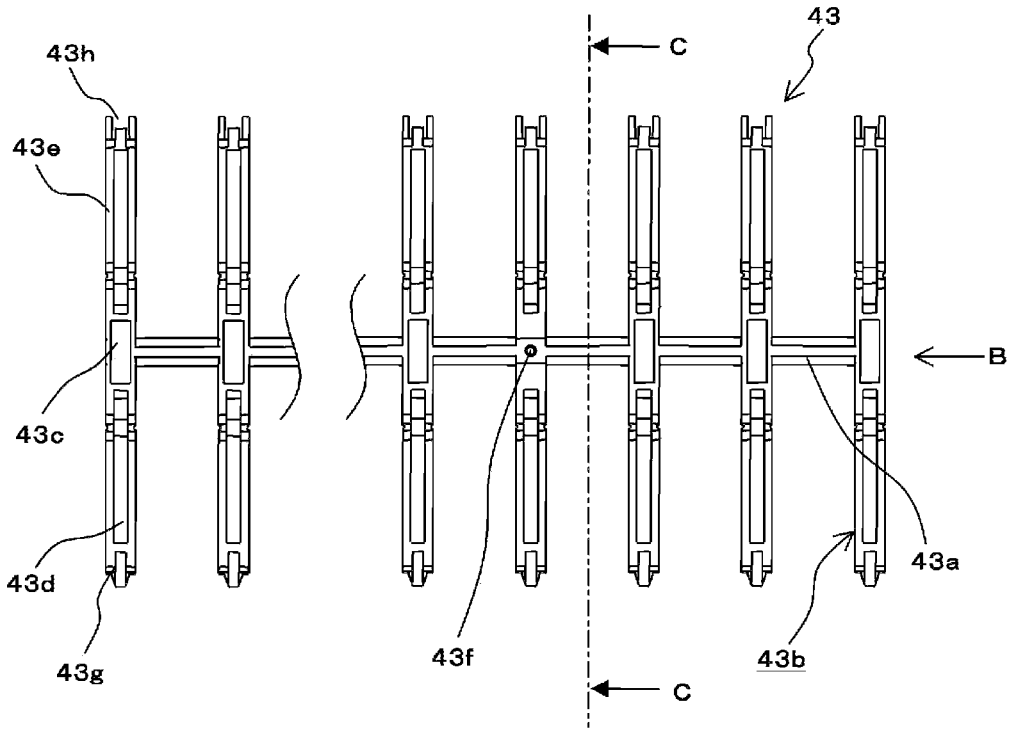
[FIG. 19A] is a partially fragmentized top view showing a configuration example of a binding component 43.
Figure 19B:
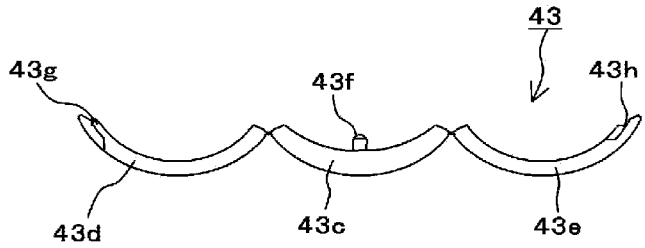
[FIG. 19B] is a diagram showing a state example seeing the binding component 43 from an arrow B.
Figure 19C:
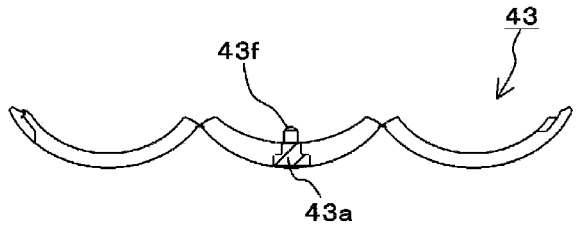
[FIG. 19C] is a cross-section diagram of the binding component 43 seen from C-C arrows.
Figure 19D:
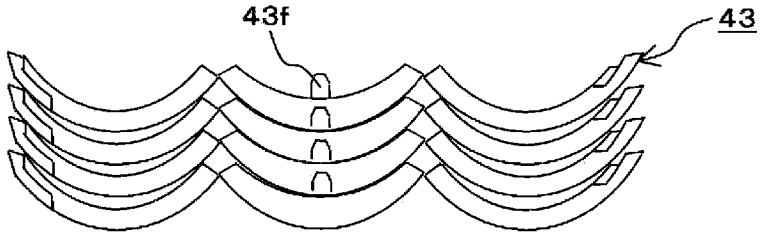
[FIG. 19D] is a diagram showing a state example seeing a state example from an arrow B in which a plurality of binding components 43 is stacked.

The following will describe a configuration example of the binding component 43 with reference to FIGS. 19A to 19D. The binding component 43 shown in FIG. 19A is a plan view showing a portion of the binding component 43. The binding component 43 has a backbone portion 43*a*, first ring portions 43*d*, second ring portions 43*c*, third ring portions 43*e*, a pin 43*f*, first coupling portions 43*g*, and second coupling portions 43*h*. The binding component 43 is an injection molded plastic component such that ring portions 43*b* are arranged with a constant interval on the backbone portion 43*a* with a length in conformity with a size of standard-size paper. FIG. 19B is a diagram showing a state seen from an arrow B in FIG. 19A. As shown in FIGS. 19A and 19B, each of the ring portions 43*b* has a configuration such that it is partitioned into three such as the ring portion 43*c* connected to the backbone portion 43*a*, the ring portion 43*d* and the ring portion 43*e*, which are jointed to the right and left thereof in the bend-free manner, and the coupling portion 43*g* and the coupling portion 43*h* are connected by bending them in their direction where the ring portion 43*b* becomes a ring shape, so that the ring portion 43*b* becomes a ring shape. FIG. 19C is a C-C sectional view of FIG. 19A. A shape of cross-section the backbone portion 43*a* of the binding component 43 shown in FIG. 19C is a convexity and this shape is for gripping the binding component 43 by the reverse L letter shaped binding component gripping claws 41*h*. FIG. 19D is a state, in which plural binding components 43 are stacked, seen from the arrow B of FIG. 19A. Also, as shown in FIGS. 19A to 19C, the ring portion 43*c* of a predetermined ring portion 43*b* has a convexity shaped pin 43*f*. An insertion hole, which is not shown, corresponding to the pin 43*f* is provided at the opposite side of the ring portion 43*c* provided with the pin 43*f*. Thus, a plurality of binding components 43 can be stacked by inserting the pin 43*f* into the insertion hole in a state in which respective both end portions of the ring portion 43*d*, the ring portion 43*c*, and the ring portion 43*e* are aligned on a straight line.

Figure 20A:
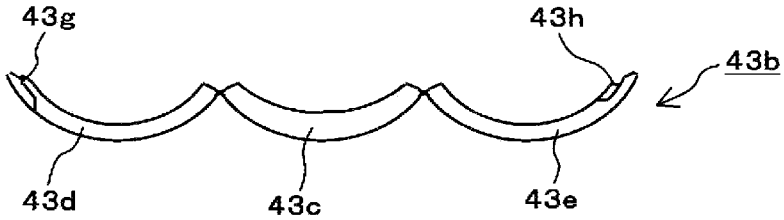
[FIG. 20A] is an explanatory diagram showing a development example of the binding component 43.
Figure 20B:
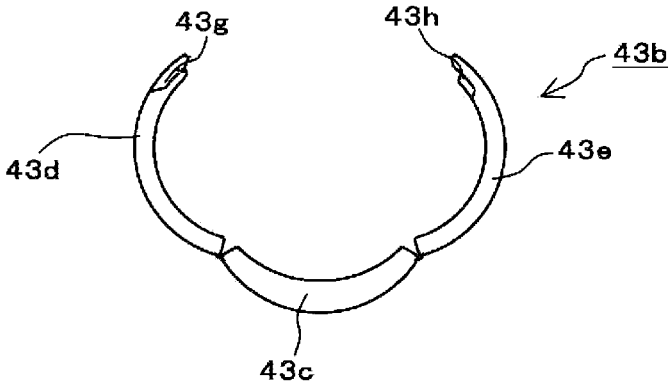
[FIG. 20B] is an explanatory diagram showing a half-binding example of the binding component 43.
Figure 20C:
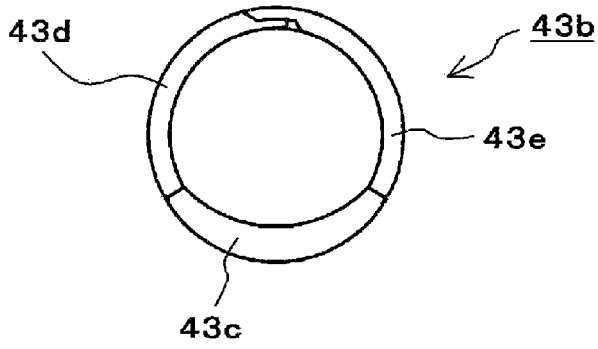
[FIG. 20C] is an explanatory diagram showing a binding example of the binding component 43.

A configuration example (open-close) of the binding component 43 will be explained with reference to FIGS. 20A to 20C. FIGS. 20A to 20C are the state in which the open-close operation of any one of the ring portion 43*b* is seen from the direction of an arrow B in FIG. 19A.

As shown in FIGS. 20A to 20C, the ring portion 43*b* is constituted in the bend-free manner at a joint portion between the ring portion 43*d* and the ring portion 43*c* and a joint portion between the ring portion 43*c* and the ring portion 43*e*, and a connecting portion 43*g* provided in a tip portion of the ring portion 43*d* and a connecting portion 43*h* provided in a tip portion of the ring portion 43*e* are constituted in a couplable manner. Thus, it is constituted such that a perfect ring can be formed by connecting the connecting portion 43*g* to the connecting portion 43*h*, by bending the ring portion 43*d* and ring portion 43*e* in the annular direction from the state in which respective both end portions of the ring portion 43*d*, the ring portion 43*c* and the ring portion 43*e* are aligned on a straight line. Also, the connecting portion 43*g* and the connecting portion 43*h* can carry out the coupling and removal in many times, thereby enabling the binding component 43 to be reused.

Also, with respect to the binding component 43 explained in FIGS. 19 and 20, a plurality of kinds in which the sizes or the like of the ring portion 43*b* are different are used in response to the thickness of the paper-sheet 3' and the bundle of paper-sheets 3" shown in FIG. 2. Also, with respect to the binding component 43 explained in FIGS. 19 and 20, each of the ring portion 43*b* has a constitution partitioned into three portions such as the ring portion 43*d*, ring portion 43*c*, and the ring portion 43*e*, but such a configuration that each of the ring portion 43*b* is partitioned by n (n is natural number) pieces may be approved.

Figure 21A:
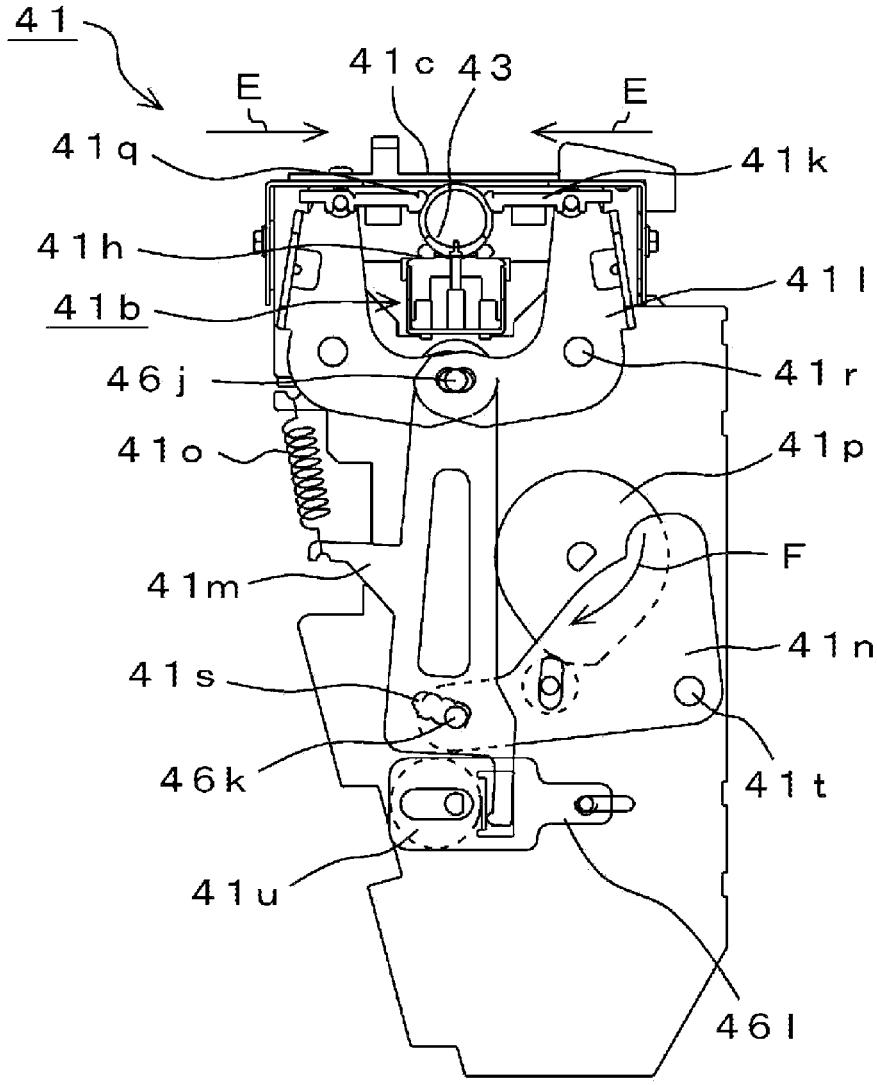
[FIG. 21A] is a schematic diagram of a cross-section showing a configuration example of the movement mechanism 41 in a binding process of the binding component 43 of large diameter.
Figure 21B:
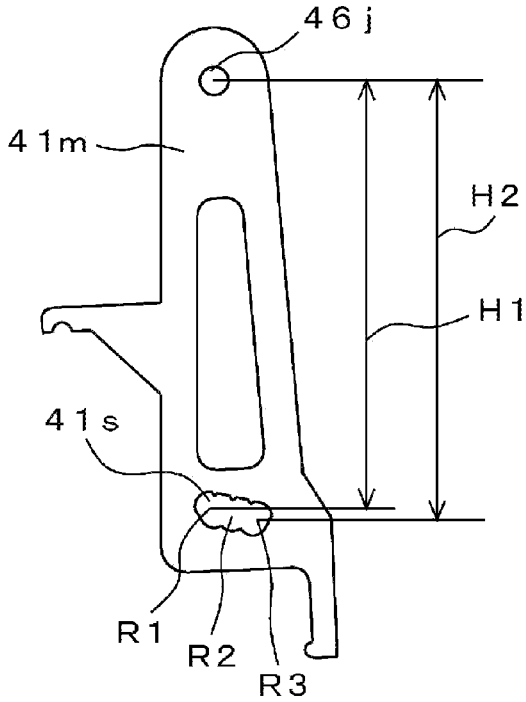
[FIG. 21B] is an enlarged view showing a configuration example of a binding claw link 41*m* of the movement mechanism 41.

The following will describe a configuration example of the movement mechanism 41 in a binding process of the binding component 43 of large diameter with reference to FIG. 21A and FIG. 21B. The movement mechanism 41 shown in FIG. 21A is a state in which the binding component 43 of large diameter is bound. The movement mechanism 41 has the opening portion 41*c*, binding claws 41*k*, binding claw links 411, a binding claw link 41*m*, a binding claw link 41*n*, a spring 41*o*, a cam 41*p* for the binding claws, a cam 41*u* for adjusting the binding component, and a binding component adjustment portion 461 and carries out the open and close of the binding claws 41*k*. The binding claws 41*k* push both tip portions of the binding component 43 held by the binding component gripping portion 41*b* inside from the both sides to insert the both tip portions of the binding component 43 into the punched holes of the paper-sheets.

The binding claws 41*k* are connected to the binding claw links 411 and move parallel to the right and left. The binding claw links 411 have a binding claw link rotating axis 41*r* and a link coupling portion 46*j* and are connected to the binding claw link 41*m* through the link coupling portion 46*j*. The binding claw link 41*m* has a binding claw link coupling hole 41*s*.

The binding claw link 41*m* shown in FIG. 21B is such that the binding claw link 41*m* shown in FIG. 21A is extracted and enlarged. The binding claw link coupling hole 41*s* has switch-modes of a coupling hole R1 for small diameter, a coupling hole R2 for medium diameter, and a coupling hole R3 for large diameter and is switchable in the three-step manner. A pitch H1 for small diameter is a distance between the coupling hole R1 for small diameter and a link coupling portion 46*j*. A pitch H2 for large diameter is a distance between the coupling hole R3 for large diameter and the link coupling portion 46*j*. When the pitch H1 for small diameter and the pitch H2 for large diameter are compared, the pitch H2 for large diameter is made longer.

The binding claw link 41*m* is connected to the binding claw link 41*n* by the link coupling portion 46*k*. The binding claw link 41*n* has a binding claw link rotating axis 41*t* and a motive force is transmitted to it by the cam 41*p* for the binding claws so that it rotates counterclockwise on the axis of the binding claw link rotating axis 41*t* in a case of binding the binding component 43. Also, the binding claw link 41*m* is provided with a spring 41*o* and any force is always applied to it toward the left upper direction. This is for preventing wobble or the like of the binding claw link 41*m* or the like when the position of the binding claw link coupling hole 41*s* is changed and for raising the accuracy of the binding process.

The cam 41*u* for adjusting the binding component allows the binding component adjust portion 461 to move parallel toward the left and right. The binding claw link 41*m* connected with the binding component adjust portion 46*l* moves to the left and right on the axis of the link coupling portion 46*j*, so that the position of the binding claw link coupling hole 41*s* is changes by the size of the binding component 43.

The movement mechanism 41 shown in FIG. 21A rotates, for example, the cam 41*p* for the binding claws to a arrow direction F by using the motor 45*d* for opening and closing the binding claw (which is not shown). Any motive force is transmitted to the binding claw link 41*n* by rotating the cam 41*p* for the binding claws and the binding claw 41*n* is pushed down on the axis of the binding claw link rotating axis 41*t*. The binding claw link 41*n* pushed down pushes down the binding claw link 41*m* connected by the link coupling portion 46*k*. The binding claw link 41*m* pushed down by the binding claw link 41*n* pushes down the binding claw link 41*l* connected by the link coupling portion 46*j*. The binding claw link 41*l* pushed down by the binding claw link 41*m* moves parallel toward the E direction where the binding portion 41*q* binds the binding claws 41*k* touching the arc portion of the binding component 43 and binds the binding component 43.

Figure 22:
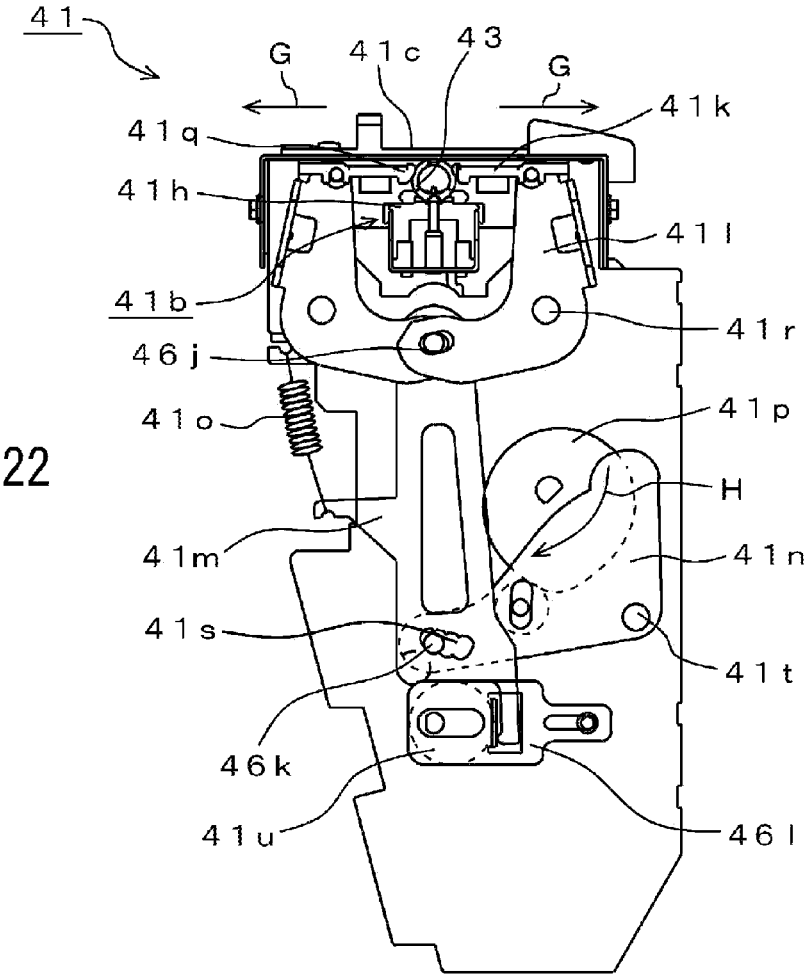
[FIG. 22] is a schematic diagram of a cross-section showing a configuration example of the movement mechanism 41 in a binding process of the binding component 43 of small diameter.

The following will describe a configuration example of the movement mechanism 41 in the binding process in a binding component 43 of small diameter with reference to FIG. 22. The movement mechanism 41 shown in FIG. 22 is a state in which the binding component 43 of small diameter is bound. Because the binding component 43 is the small diameter, the link coupling portion 46*k* is set to the coupling hole R1 for small diameter shown in FIG. 21B. Thus, in a case in which the binding component 43 of small diameter is bound by the right and left binding claws 41*k*, the larger stroke can be taken in comparison with one of the binding component 43 of large diameter.

Figure 23A:
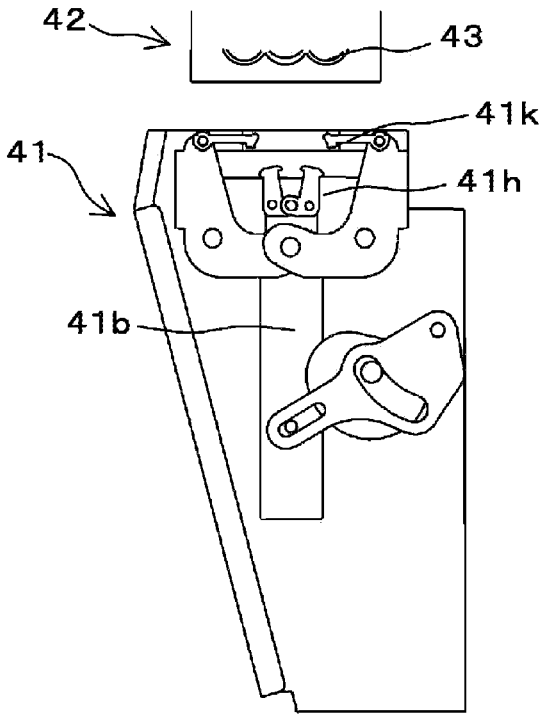
[FIG. 23A] is a diagram showing a state example of the binding component gripping portion 41*b* positioned at the lowermost portion.
Figure 23B:
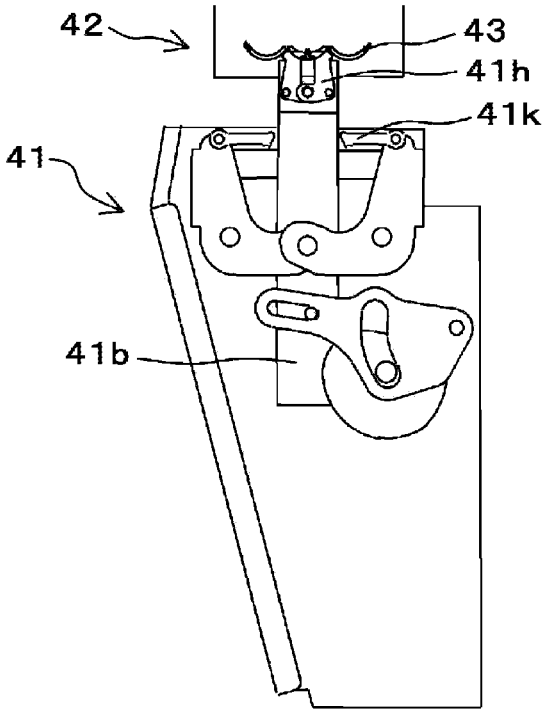
[FIG. 23B] is a diagram showing a state example in which the binding component 43 is gripped by a binding component gripping claw 41*h*.
Figure 23C:
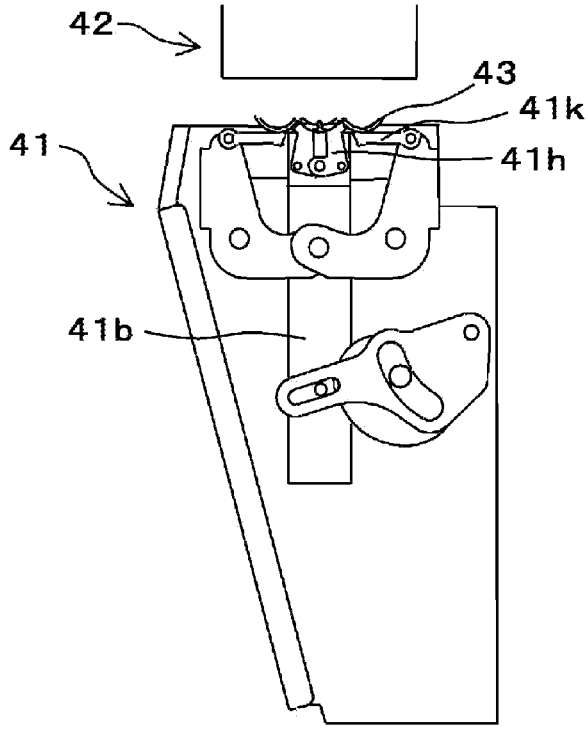
[FIG. 23C] is a diagram showing a state example in which the binding component 43 contacts binding claws 41*k*.
Figure 23D:
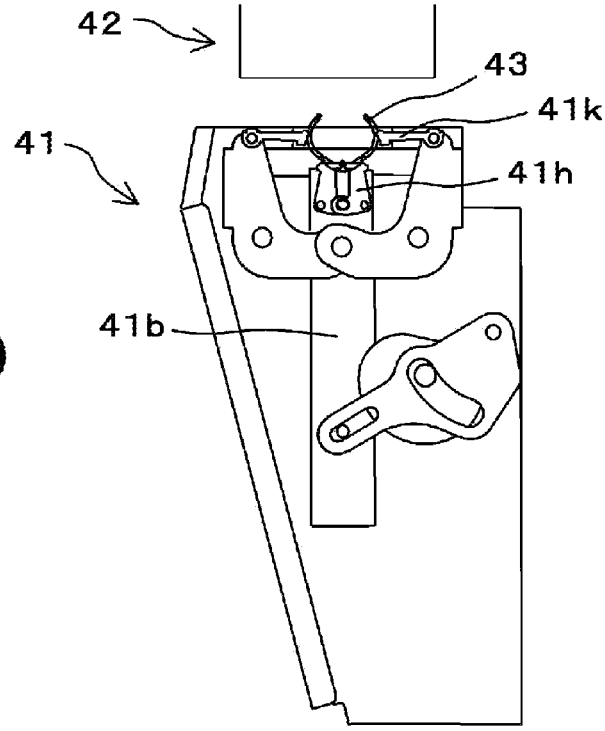
[FIG. 23D] is a diagram showing a movement example toward a lower side of the binding component gripping portion 41*b*.

The following will describe an operation example of the movement mechanism 41 in the binding component acquisition with reference to FIGS. 23A to 23D. The movement mechanism 41 shown in FIGS. 23A to 23D has the same configuration example as that of the movement mechanism 41 shown in FIG. 18A and FIG. 18B. The binder cassette 42 is shown so that the state of interior can be seen with leaving the lower portion by about one-fifth, to understand the operation process of extracting the binding component 43. The movement mechanism 41 shown in FIG. 23A is a state in which the binding component gripping portion 41*b* is positioned at the lowermost portion (hereinafter, referred to as waiting state) and is a state before the control unit 50 receives the paper-sheet detection signal Sc shown in FIG. 17. The movement mechanism 41 shown in FIG. 23B is a state in which after the control unit 50 received the paper-sheet detection signal Sc, the binding component gripping portion 41*b* is moved up to the uppermost portion and the binding component 43 is gripped by the binding component gripping claws 41*h*. The movement mechanism 41 shown in FIG. 23C is a state in which the binding component 43 is gripped by the binding component gripping claw 41*h* and extracted from the binder cassette 42. The movement mechanism 41 shown in FIG. 23D is a state in which after extracting the binding component 43 by gripping it with the binding component gripping claw 41*h* from the binder cassette 42, in the manner shown in FIG. 21 and FIG. 22, the stroke of the binding claws 41*k* is adjusted in conformity with the size of diameter of the binding component 43 and the binding component 43 is made to be a half-bound state (hereinafter, referred to as the first forming).

The binding claws 41*k* shown in FIG. 23D widen the distance between both tips of the binding claws 41*k* and wait for receiving the binding component 43 when receiving the binding component 43 having a large diameter while the binding claws 41*k* narrow the distance between both tips of the binding claws 41*k* and wait for receiving the binding component 43 when receiving the binding component 43 having a diameter smaller than the large diameter. The binding component gripping portion 41*b* allows the arc portion of the binding component 43 to contact both tips of the binding claws 41*k* that wait for receiving the binding component 43, and also fixes the binding component 43 at a position where both tips of the binding claws 41*k* are in the vicinity of the both tips of the binding component 43. The binding claws 41*k* insert both tips of the binding component 43 fixed by the binding component gripping portion 41*b* into the punch holes in the bundle of paper-sheet 3" shown in FIG. 24A.

Figure 24A:
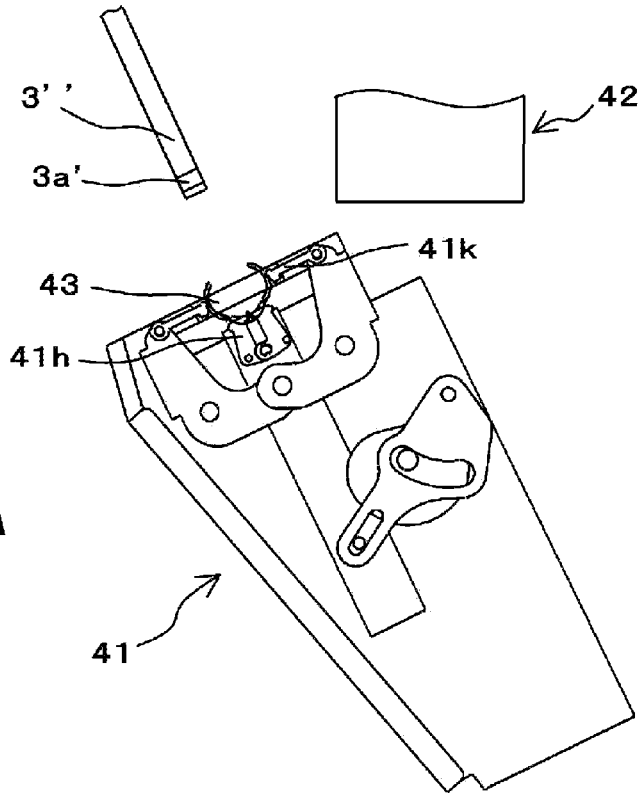
[FIG. 24A] is a diagram showing a movement example to a paper-sheet binding position of the movement mechanism 41.
Figure 24B:
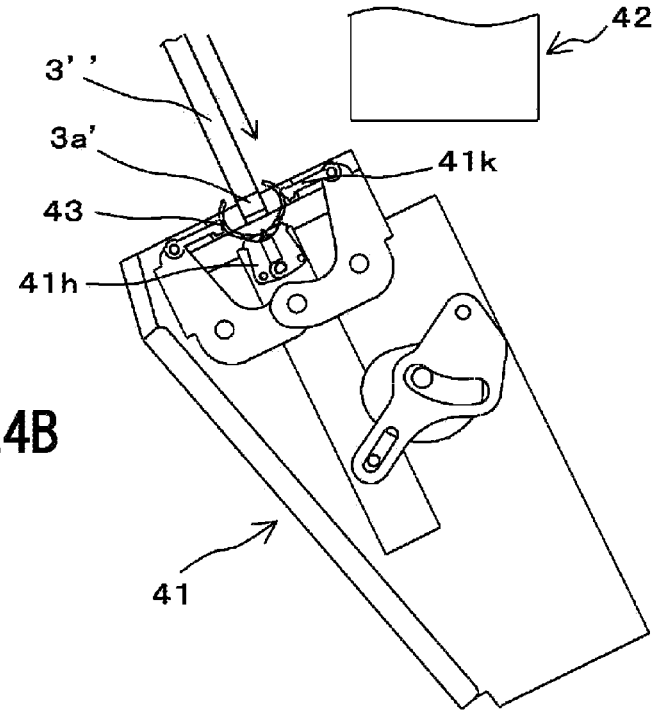
[FIG. 24B] is a diagram showing a movement example of a bundle of paper-sheets 3" with respect to the binding component 43.
Figure 24C:
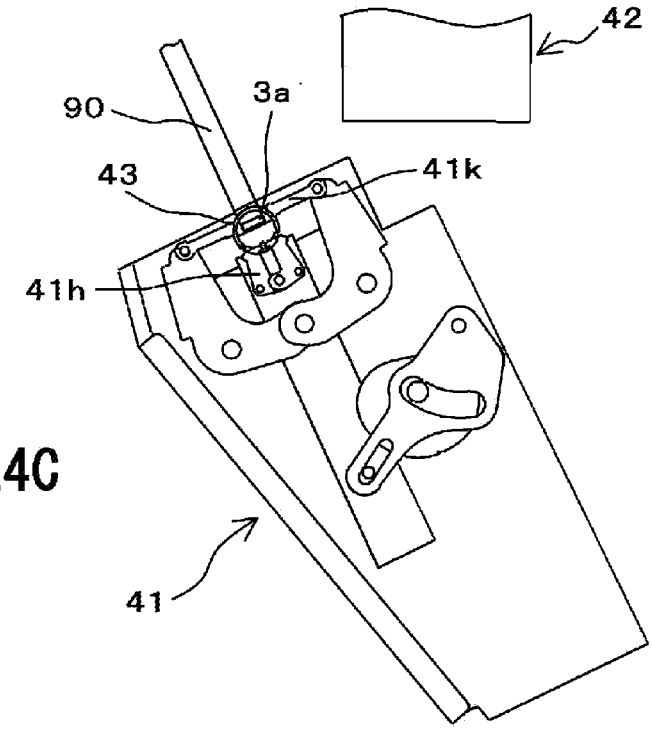
[FIG. 24C] is a diagram showing an operation example of the binding claws 41*k* when binding the binding component 43 to the bundle of paper-sheets 3".
Figure 24D:
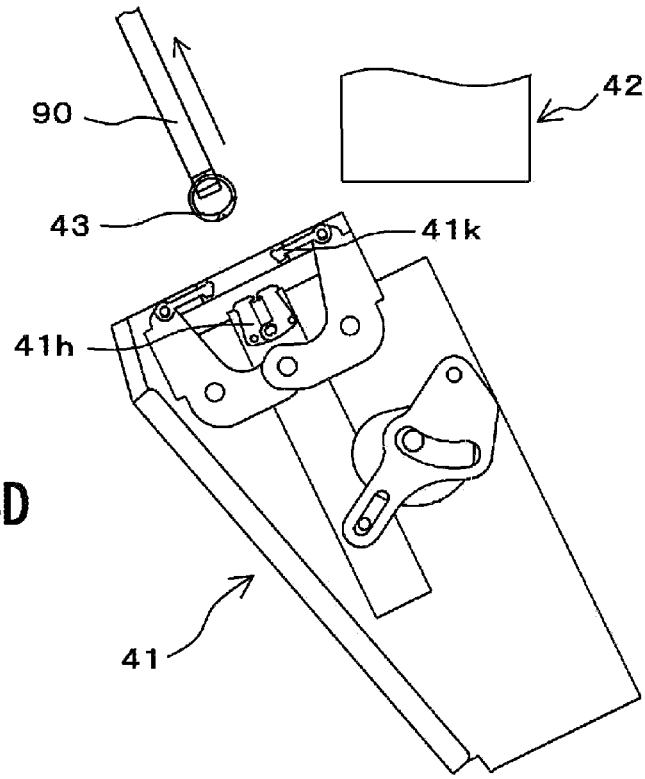
[FIG. 24D] is a diagram showing a movement example of the bundle of paper-sheets 3" and an operation example of the movement mechanism 41 after the time of the binding.

The following will describe an operation example of the movement mechanism 41 in the binding process with reference to FIGS. 24A to 24D. The movement mechanism 41 shown in FIGS. 24A to 24D has the same configuration example as that of the movement mechanism 41 shown in FIG. 18A and FIG. 18B. The binder cassette 42 is shown so that the state of interior can be seen with leaving the lower portion by about one-fifth, to understand the operation process of extracting the binding component 43. The movement mechanism 41 shown in FIG. 24A is a state in which it rotates counterclockwise from the first forming on the axis of the movement mechanism rotating axis 41*d* shown in FIG. 4, and moves to the paper alignment unit 30. The bundle of paper-sheet 3, is such that, only the bundle of the paper-sheet 3" is extracted from the paper alignment unit 30 shown in FIG. 5. The movement mechanism 41 shown in FIG. 24B is a state in which the paper alignment unit 30 inserts the bundle of the paper-sheet 3" into the opening portion 41*c* of the movement mechanism 41. The movement mechanism 41 shown in FIG. 24C is a state in which the binding component 43 is bound to the bundle of paper-sheets 3" inserted into the opening portion 41*c* of the movement mechanism 41 by the paper alignment unit 30 and it becomes a booklet 90. The movement mechanism 41 shown in FIG. 24D is a state in which the paper alignment unit 30 moves the booklet 90 bound by the binding component 43 in an arrow direction. The booklet 90 is delivered to the subsequent progress. The movement mechanism 41 moves to the waiting state shown in FIG. 23A.

The following will describe a usage example of the binding component guide members 99*a*, 99*b* (for binding component 43 for large diameter) with reference to FIGS. 25A to 25D. For FIGS. 25A to 25D, as explained in FIG. 12, it is assumed that the positions of punch holes 98 of the bundle of paper-sheets 3" are aligned, and also the bundle of paper-sheets 3" is held and fixed by the comb shaped pressing members 84*a*, 84*b* in a state in which positions of the binding component guide members 99*a*, 99*b* can be fitted to a position covering about half size of each of the punch holes 98.

Figure 25A:
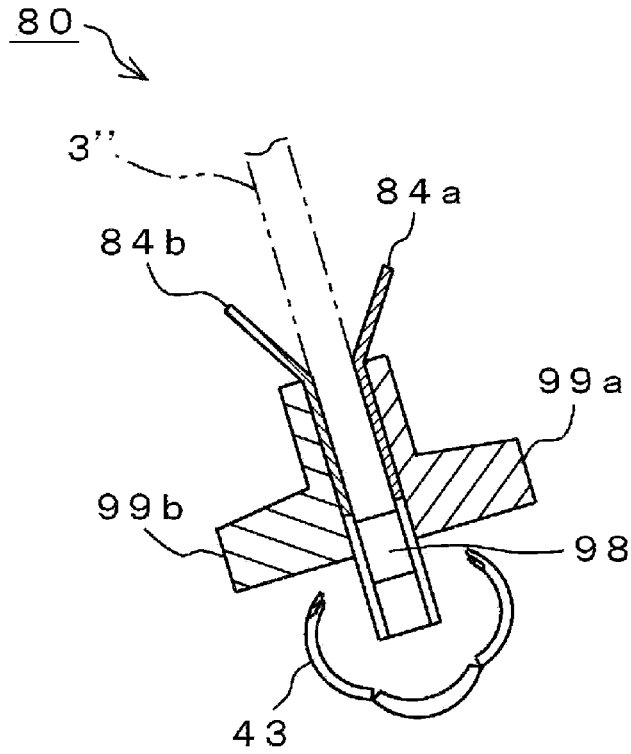
[FIG. 25A] is an explanatory diagram showing a usage example (No.1 thereof) of binding component guide members 99*a*, 99*b* in case of the binding component 43 of large diameter.
Figure 25B:
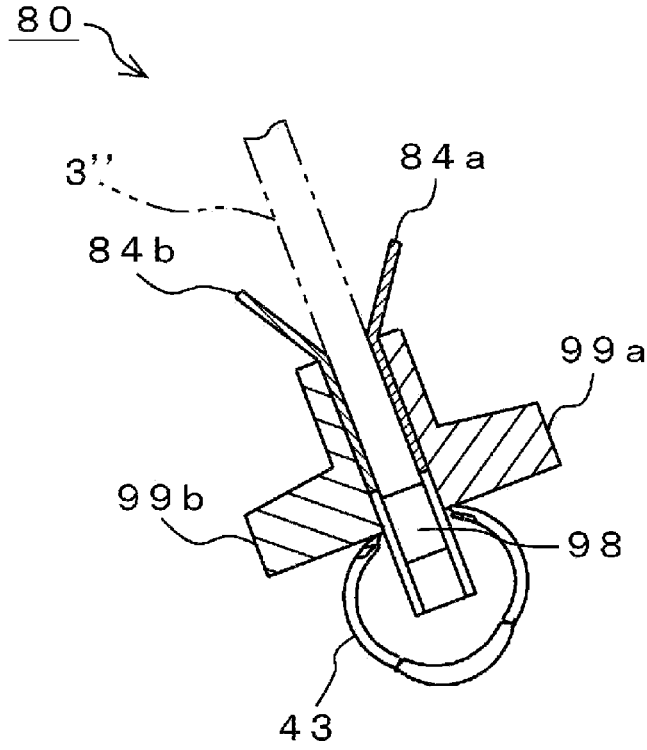
[FIG. 25B] is an explanatory diagram showing a usage example (No.2 thereof) of the binding component guide members 99*a*, 99*b*.
Figure 25C:
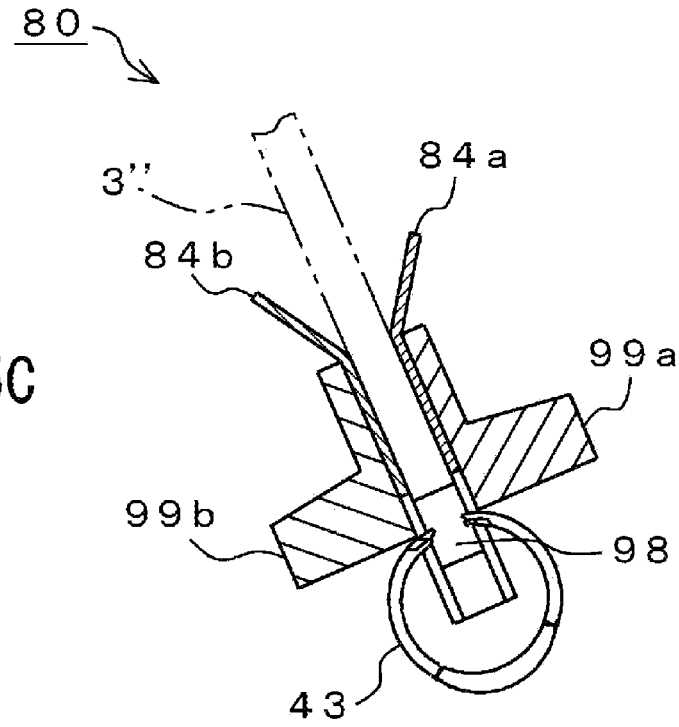
[FIG. 25C] is an explanatory diagram showing a usage example (No.3 thereof) of the binding component guide members 99*a*, 99*b*.
Figure 25D:
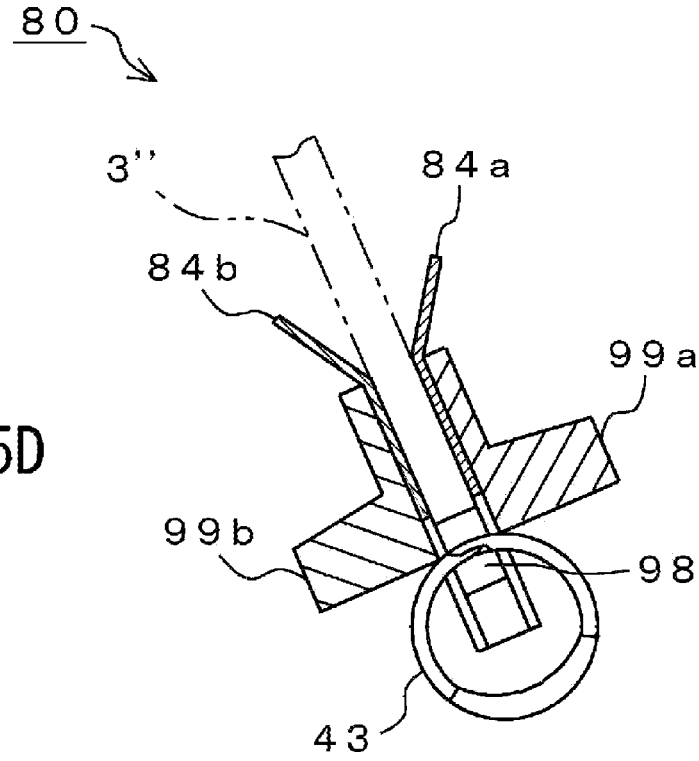
[FIG. 25D] is an explanatory diagram showing a usage example (No.4 thereof) of the binding component guide members 99*a*, 99*b*.

The binding component 43 shown in FIG. 25A is a starting state of inserting the aforesaid binding component 43 to the punch holes 98. The binding component 43 shown in FIG. 25B is a state in which both tip portions of the binding component 43 are contacted the binding component guide members 99*a*, 99*b* and the both tip portions of the binding component 43 are inserted into the punch holes 98. The binding component 43 shown in FIG. 25C is a state in which the both tip portions of the binding component 43 are inserted into the punch holes 98 from a state in which the both tip portions of the binding component 43 are contacted to the binding component guide members 99*a*, 99*b*. The binding component 43 shown in FIG. 25D is a state in which the both tip portions of the binding component 43 are bound to the punch holes 98 while contacting arc portion to the binding component guide members 99*a*, 99*b* from the both tip portions of the binding component 43 from a state in which the both tip portions of the binding component 43 are inserted into the punch holes 98.

Thus, it is possible to insert the both tip portions of the binding component 43 into the punch holes 98 while keeping the distance between the both tip portions of the binding component 43 and the punch holes 98 substantially constant.

The following will describe a usage example of the binding component guide members 99*a*, 99*b* (for binding component 43 for small diameter) with reference to FIGS. 26A to 26D. In this embodiment, as explained in FIG. 12, it is assumed that positions of the punch holes of the bundle of paper-sheets 3" are aligned, and also the bundle of paper-sheets 3" is held and fixed by the comb shaped pressing members 84*a*, 84*b* in a state in which positions of the binding component guide members 99*a*, 99*b* can be fitted to a position covering about half size of the punch holes 98.

Figure 26A:
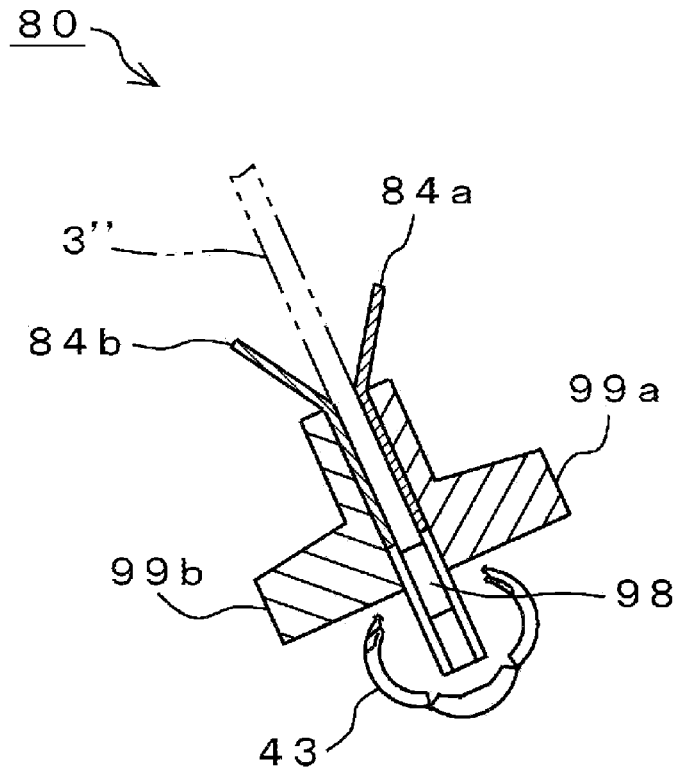
[FIG. 26A] is an explanatory diagram showing a usage example (No.1 thereof) of the binding component guide members 99*a*, 99*b* in case of the binding component 43 of small diameter.
Figure 26B:
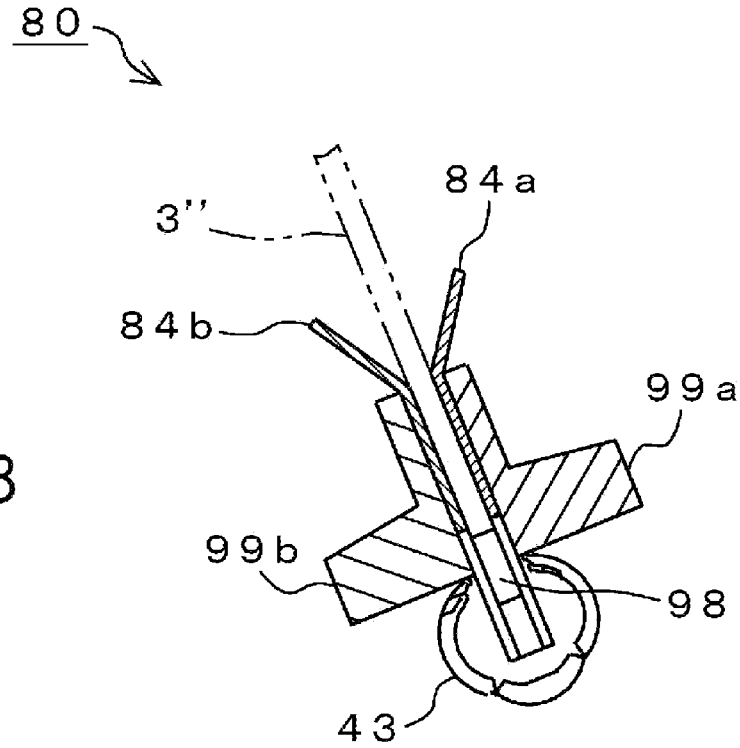
[FIG. 26B] is an explanatory diagram showing a usage example (No.2 thereof) of the binding component guide members 99*a*, 99*b*.
Figure 26C:
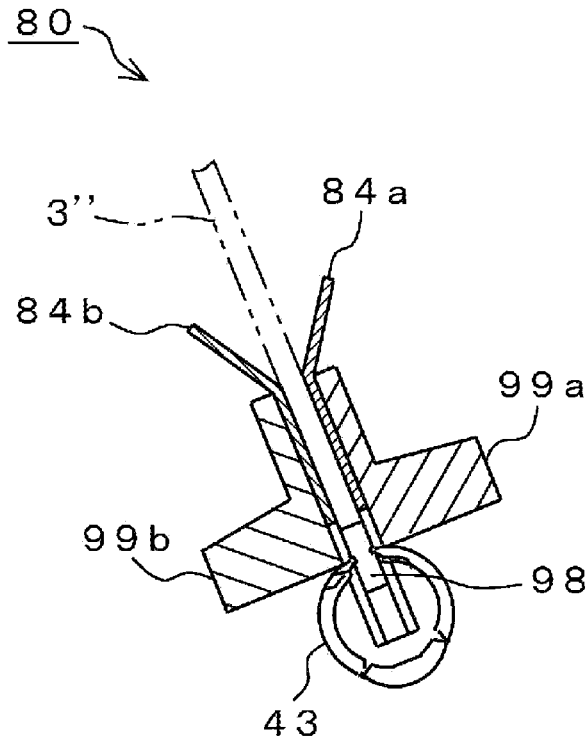
[FIG. 26C] is an explanatory diagram showing a usage example (No.3 thereof) of the binding component guide members 99*a*, 99*b*.
Figure 26D:
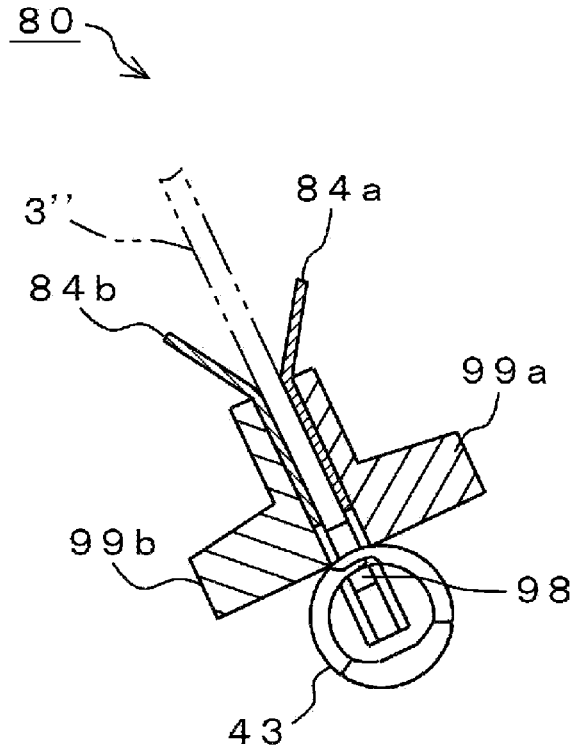
[FIG. 26D] is an explanatory diagram showing a usage example (No.4 thereof) of the binding component guide members 99*a*, 99*b*.

The binding component 43 shown in FIG. 26A is a starting state of inserting the binding component 43 into the punch holes 98. The binding component 43 shown in FIG. 26B is a state in which both tip portions of the binding component 43 are contacted to the binding component guide members 99*a*, 99*b* and the both tip portions of the binding component 43 are inserted to the punch holes 98. The binding component 43 shown in FIG. 26C is a state in which the both tip portions of the binding component 43 are inserted to the punch holes 98 from a state in which the both tip portions of the binding component 43 are contacted to the binding component guide members 99*a*, 99*b*. The binding component 43 shown in FIG. 26D is a state in which the binding component 43 is bound to the punch holes 98 while contacting arc portion to the binding component guide members 99*a*, 99*b* from the both tip portions of the binding component 43 from a state in which the both tip portions of the binding component 43 are being inserted into the punch holes 98.

Thus, it is possible to insert the both tip portions of the binding component 43 into the punch holes 98 while keeping the distance between both tip portions of the binding component 43 and the punch holes 98 substantially constant. Consequently, in case of the binding components 43 of different diameters, it is possible to keep the distance between any of the binding components 43 and the punch holes substantially constant.

The following will describe a clearance comparison example between each of the binding components 43 for large and small diameters and the punch holes 98 with reference to FIGS. 27A to 27D.

Figure 27A:
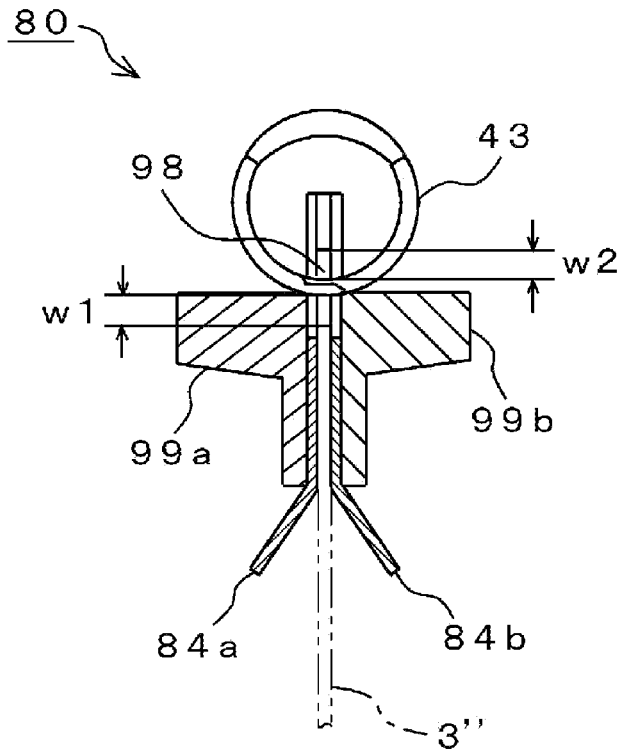
[FIG. 27A] is a diagram showing a clearance example between the binding component 43 of large diameter and each punch hole 98 in a thin state of the bundle of paper-sheets 3".

The binding component 43 shown in FIG. 27A is for large diameter and the bundle of paper-sheets 3" is a thin state. W1 indicates a clearance between each of the punch holes 98 and an outer diameter of the binding component 43 and w2 indicates a clearance between each of the punch holes 98 and an inner diameter of the binding component 43.

Figure 27B:
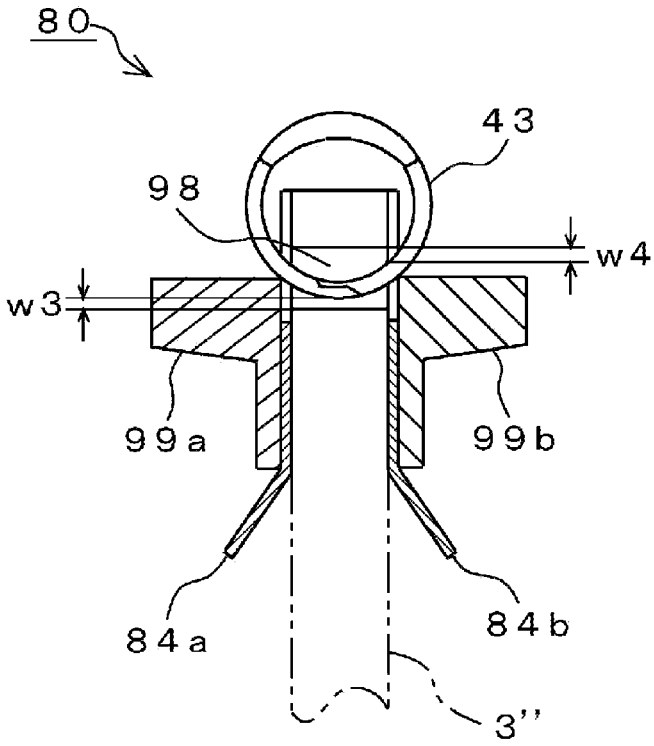
[FIG. 27B] is a diagram showing a clearance example between the binding component 43 of large diameter and each of the punch holes 98 in a thick state of the bundle of paper-sheets 3".

The binding component 43 shown in FIG. 27B is for large diameter and the bundle of paper-sheets 3" is a thickest state at the time of large diameter. W3 indicates a clearance between each of the punch holes 98 and an outer diameter of the binding component 43 and w4 indicates a clearance between each of the punch holes 98 and an inner diameter of the binding component 43. Such a state that the binding component 43 is for large diameter and also the bundle of paper-sheets 3" is a thickest state is a most difficult condition to maintain clearances of outer diameter and inner diameter. Therefore, in a case in which the extent that binding component guide members 99*a*, 99*b* cover the punch holes 98 is determined, the positions of the binding component guide members 99*a*, 99*b* being applied to the punch holes 98 is set so as to maintain a sufficient clearance when the binding component 43 is for large diameter and also the bundle of paper-sheets 3" is a thickest state.

By setting the positions of the binding component guide members 99*a*, 99*b* in the most difficult condition to maintain this clearance, it becomes possible to maintain a sufficient clearance without depending on the size of diameter and a thickness of the bundle of paper-sheets 3" in all other binding components 43.

Figure 27C:
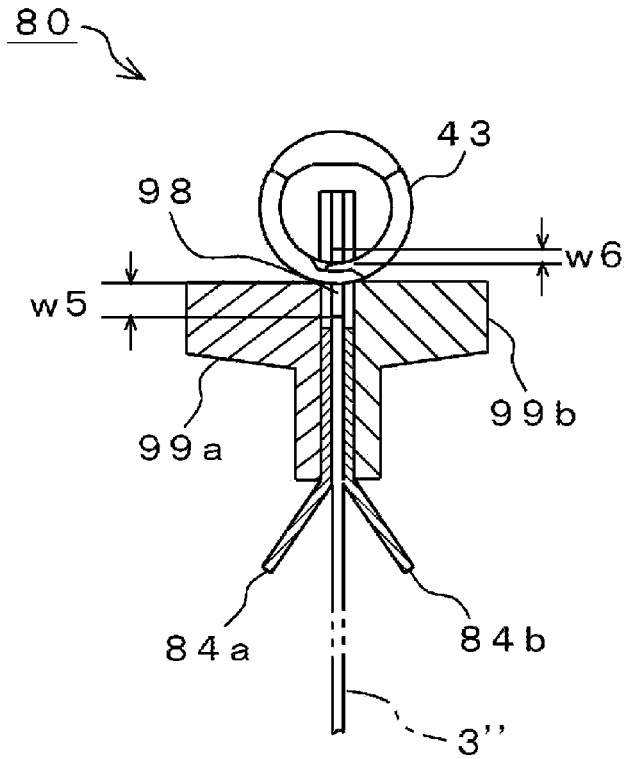
[FIG. 27C] is a diagram showing a clearance example between the binding component 43 of small diameter and each of the punch holes 98 in the thin state of the bundle of paper-sheets 3".
Figure 27D:
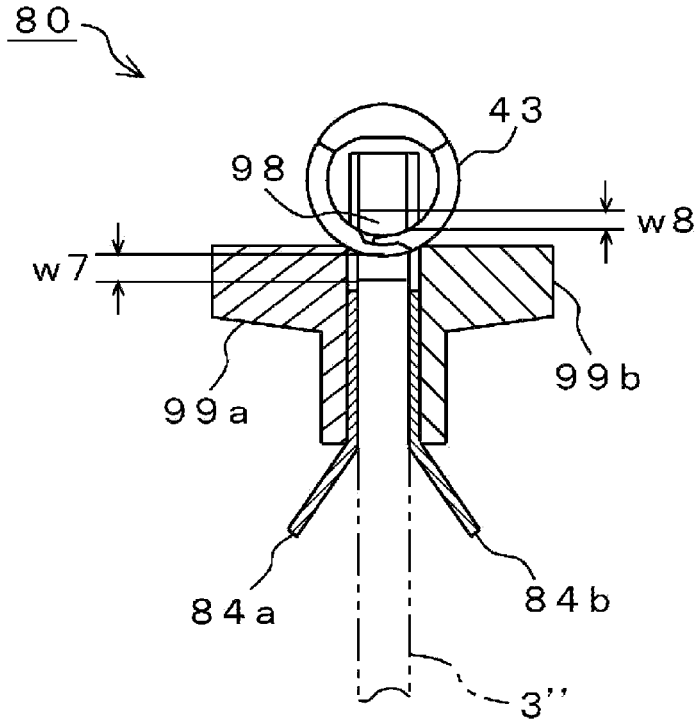
[FIG. 27D] is a diagram showing a clearance example between the binding component 43 of small diameter and each of the punch holes 98 in the thick state of the bundle of paper-sheets 3".

The binding component 43 shown in FIG. 27C is for small diameter and the bundle of paper-sheets 3" is a thin state. W5 indicates a clearance between each of the punch holes 98 and an outer diameter of the binding component 43 and w6 indicates a clearance between each of the punch holes 98 and an inner diameter of the binding component 43. The binding component 43 shown in FIG. 27D is for small diameter and the bundle of paper-sheets 3" is a thickest state at the time of small diameter. W7 indicates a clearance between each of the punch holes 98 and an outer diameter of the binding component 43 and w8 indicates a clearance between each of the punch holes 98 and an inner diameter of the binding component 43.

Thus, by the binding device 100 to which the paper-sheet handling device as an embodiment according to the present invention is applied, the clamp movement mechanism 80 for attaching the binding component guide members 99*a*, 99*b* to a position covering a portion of each of the punch holes 98 from the front and rear surfaces of the bundle of paper-sheets 3" to sandwich the bundle of paper-sheets 3" and the movement mechanism 41 for binding the binding component 43 to the bundle of paper-sheets 3" while contacting both tip portions of the binding component 43 to the binding component guide members 99*a*, 99*b* sandwiching the bundle of paper-sheets 3" by the clamp movement mechanism 80 are provided.

By this configuration, it is possible to insert both tip portions of the binding component 43 into each of the punch holes 98 while keeping the distance between the both tip portions of the binding component 43 and each of the punch holes 98 substantially constant. Consequently, even in case of the binding components 43 of different diameters, the distance between any of the binding components 43 and each of the punch holes 98 can be kept substantially constant. Thus, a highly accurate binding process can be realizes by a simple component configuration without depending on accumulated tolerance by the manufacturing and combination of aforesaid device components.

INDUSTRIAL APPLICABILITY

This invention is very preferable to be applied to a binding device for carrying out the binding process to the recording paper-sheets released from a copy machine or a print machine for black-and-white use and for color use.

The invention claimed is:

1. A paper-sheet handling device for handling a plurality of paper-sheets each being perforated at predetermined positions in a row along one edge of the paper-sheet, wherein the paper-sheet handling device comprises:

pressing means for guiding each of the plurality of paper-sheets to a predetermined position, in which the perforations in the respective sheets are aligned, and pressing the paper-sheets together to form a bundle of paper-sheets, whereby aligned perforations in the sheets form corresponding holes in the bundle of paper-sheets, the holes being in a row along one edge of the bundle of paper-sheets and the bundle of paper-sheets having first and second opposite sides;

a guide-and-sandwich structure comprising first and second guide members for engaging the bundle of paper-sheets at the first and second sides respectively and sandwiching the bundle of paper-sheets;

an alignment pin for penetrating a first hole in the bundle of paper-sheets; and a binding means for binding a binding component to the bundle of paper-sheets by inserting first and second tip portions of the binding component into a second hole in the bundle of paper sheets from the first and second sides respectively of the bundle, and wherein the alignment pin is positioned relative to the guide members such that when the alignment pin penetrates the first hole in the bundle of paper-sheets each guide member covers a portion of the second hole in the bundle of paper-sheets at its respective side of the bundle of paper-sheets, whereby the first and second tip portions of the binding component contact the first and second guide members respectively while being inserted in the second hole in the bundle of paper-sheets.

2. The paper-sheet handling device according to claim 1, wherein at least one of the guide members has an edge disposed towards the alignment pin, said edge having two straight segments separated by a concave recess in which a portion of the alignment pin is located, whereby one of said straight segments covers said portion of the second hole in the bundle of paper-sheets.

3. A paper-sheet handling device for handling a plurality of paper-sheets each being perforated at predetermined positions in a row along one edge of the paper-sheet, wherein the paper-sheet handling device comprises:

pressing means for guiding each of the plurality of paper-sheets to a predetermined position, in which the perforations in the respective sheets are aligned, and pressing the paper-sheets together to form a bundle of paper-sheets, whereby aligned perforations in the sheets form corresponding holes in the bundle of paper-sheets, the holes being in a row along one edge of the bundle of paper-sheets and the bundle of paper-sheets having first and second opposite sides;

a guide-and-sandwich structure comprising first and second guide members for engaging the bundle of paper-sheets at the first and second sides respectively and sandwiching the bundle of paper-sheets;

first and second alignment pins for penetrating first and second holes respectively in the bundle of paper-sheets; and a binding means for binding a binding component to the bundle of paper-sheets by inserting first and second tip portions of the binding component into a third hole in the bundle of paper sheets from the first and second sides respectively of the bundle, and wherein the binding means is positioned relative to the first and second alignment pins for inserting the tip portions of the binding component into a third hole located between the first and second holes, and the first and second alignment pins are positioned relative to the guide members such that when the first and second alignment pins penetrate the first and second holes respectively each guide member covers a portion of the third hole in the bundle of paper-sheets at its respective side of the bundle of paper-sheets, whereby the first and second tip portions of the binding component contact the first and second guide members respectively while being inserted in the third hole in the bundle of paper-sheets.

4. The paper-sheet handling device according to claim 3, wherein the first and second guide members each have two opposite end regions and a an edge disposed towards the alignment pins, the edge of each guide member has first and second concave recesses in the two opposite end regions respectively, a portion of the first alignment pin is located in the first concave recesses of the guide members, a portion of the second alignment pin is located in the second concave recesses of the guide members, and the first and second concave recesses of each guide member are separated by a straight edge segment of the guide member, whereby the straight edge segments of the first and second guide members cover said portion of the third hole in the bundle of paper-sheets.

5. The paper-sheet handling device according to claim 4, wherein the portions of the alignment pins that are located in the concave recesses are substantially uniform in diameter and the concave recesses are substantially semicircular and of diameter at least as great as the diameter of the alignment pins.

* * * * *